US007629942B2

(12) United States Patent
Kato

(10) Patent No.: US 7,629,942 B2
(45) Date of Patent: Dec. 8, 2009

(54) ANTENNA

(75) Inventor: Noboru Kato, Moriyama (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 360 days.

(21) Appl. No.: 11/688,290

(22) Filed: Mar. 20, 2007

(65) Prior Publication Data

US 2008/0224935 A1 Sep. 18, 2008

Related U.S. Application Data

(60) Provisional application No. 60/745,884, filed on Apr. 28, 2006.

(30) Foreign Application Priority Data

Apr. 14, 2006 (JP) ..... 2006-112352
Sep. 20, 2006 (JP) ..... 2006-254153
Nov. 17, 2006 (JP) ..... 2006-311546

(51) Int. Cl.
*H01Q 1/50* (2006.01)
*H01Q 7/00* (2006.01)
*H01Q 21/00* (2006.01)

(52) U.S. Cl. ..... 343/860; 343/748; 343/867

(58) Field of Classification Search ..... 343/702, 343/860, 862, 867, 895, 748
See application file for complete search history.

(56) References Cited

U.S. PATENT DOCUMENTS 3,364,564 A 1/1968 Kurtz et al.
4,794,397 A 12/1988 Ohe et al.
5,232,765 A 8/1993 Yano et al.
5,253,969 A 10/1993 Richert
5,337,063 A 8/1994 Takahira
5,374,937 A 12/1994 Tsunekawa et al.
5,399,060 A 3/1995 Richert
5,491,483 A 2/1996 D'Hont
5,757,074 A 5/1998 Matloubian et al.
5,854,480 A 12/1998 Noto
5,903,239 A 5/1999 Takahashi et al.
5,936,150 A 8/1999 Kobrin et al.
5,955,723 A 9/1999 Reiner (Continued)

FOREIGN PATENT DOCUMENTS

DE 10 2006 057 369 A1 6/2008

(Continued)

OTHER PUBLICATIONS

English translation of NL9100176, published on Mar. 2, 1992.

(Continued)

*Primary Examiner*—Shih-Chao Chen
(74) *Attorney, Agent, or Firm*—Keating & Bennett, LLP

(57) ABSTRACT

An antenna includes inductance elements that are magnetically coupled together, an LC series resonant circuit that includes one of the inductance elements capacitance elements, and an LC series resonant circuit that includes another of the inductance elements and capacitance elements. The plurality of LC series resonant circuits are used to radiate radio waves and are used as inductances of a matching circuit that matches an impedance when a power supply side is viewed from power supply terminals and a radiation impedance of free space.

1 Claim, 22 Drawing Sheets

U.S. PATENT DOCUMENTS 5,995,006 A 11/1999 Walsh
6,104,311 A 8/2000 Lastinger
6,107,920 A 8/2000 Eberhardt et al.
6,172,608 B1 1/2001 Cole
6,181,287 B1 1/2001 Beigel
6,190,942 B1 2/2001 Wilm et al.
6,249,258 B1 6/2001 Bloch et al.
6,259,369 B1 7/2001 Monico
6,271,803 B1 8/2001 Watanabe et al.
6,335,686 B1 1/2002 Goff et al.
6,362,784 B1 3/2002 Kane et al.
6,367,143 B1 4/2002 Sugimura
6,378,774 B1 4/2002 Emori et al.
6,406,990 B1 6/2002 Kawai
6,448,874 B1 9/2002 Shiino et al.
6,462,716 B1 10/2002 Kushihi
6,542,050 B1 4/2003 Arai et al.
6,600,459 B2 * 7/2003 Yokoshima et al. ..... 343/895
6,634,564 B2 10/2003 Kuramochi
6,664,645 B2 12/2003 Kawai
6,763,254 B2 7/2004 Nishikawa
6,812,707 B2 11/2004 Yonezawa et al.
6,828,881 B2 12/2004 Mizutani et al.
6,837,438 B1 1/2005 Takasugi et al.
6,927,738 B2 8/2005 Senba et al.
6,963,729 B2 11/2005 Uozumi
7,088,249 B2 8/2006 Senba et al.
7,088,307 B2 * 8/2006 Imaizumi ..... 343/860
7,112,952 B2 9/2006 Arai et al.
7,119,693 B1 10/2006 Devilbiss
7,129,834 B2 10/2006 Naruse et al.
7,248,221 B2 7/2007 Kai et al.
7,250,910 B2 7/2007 Yoshikawa et al.
7,276,929 B2 10/2007 Arai et al.
7,317,396 B2 1/2008 Ujino
7,405,664 B2 7/2008 Sakama et al.
2002/0011967 A1 1/2002 Goff et al.
2002/0044092 A1 4/2002 Kushihi
2002/0067316 A1 6/2002 Yokoshima et al.
2003/0006901 A1 1/2003 Kim et al.
2003/0020661 A1 1/2003 Sato
2003/0169153 A1 9/2003 Muller
2004/0001027 A1 1/2004 Killen et al.
2004/0066617 A1 4/2004 Hirabayashi et al.
2004/0217915 A1 11/2004 Imaizumi
2004/0219956 A1 11/2004 Iwai et al.
2004/0227673 A1 11/2004 Iwai et al.
2005/0092836 A1 5/2005 Kudo
2005/0099337 A1 5/2005 Takei et al.
2005/0125093 A1 6/2005 Kikuchi et al.
2005/0134460 A1 6/2005 Usami
2005/0138798 A1 6/2005 Sakama et al.
2005/0140512 A1 6/2005 Sakama et al.
2005/0232412 A1 10/2005 Ichihara et al.
2005/0236623 A1 10/2005 Takechi et al.
2005/0275539 A1 12/2005 Sakama et al.
2006/0001138 A1 1/2006 Sakama et al.
2006/0055601 A1 3/2006 Kameda et al.
2006/0071084 A1 4/2006 Detig et al.
2006/0109185 A1 5/2006 Iwai et al.
2006/0145872 A1 7/2006 Tanaka et al.
2006/0158380 A1 7/2006 Son et al.
2006/0170606 A1 8/2006 Yamagajo et al.
2006/0220871 A1 10/2006 Baba et al.
2006/0267138 A1 11/2006 Kobayashi
2007/0004028 A1 1/2007 Lair et al.
2007/0018893 A1 1/2007 Kai et al.
2007/0040028 A1 2/2007 Kawamata
2007/0052613 A1 3/2007 Gallschuetz et al.
2007/0069037 A1 3/2007 Kawai
2007/0132591 A1 6/2007 Khatri
2007/0164414 A1 7/2007 Dokai et al.
2007/0252700 A1 11/2007 Ishihara et al.
2007/0252703 A1 11/2007 Kato et al.
2007/0285335 A1 12/2007 Bungo et al.
2008/0024156 A1 1/2008 Arai et al.
2008/0087990 A1 4/2008 Kato et al.
2008/0169905 A1 7/2008 Slatter
2008/0272885 A1 11/2008 Atherton
2009/0002130 A1 1/2009 Kato
2009/0009007 A1 1/2009 Kato et al.
2009/0065594 A1 3/2009 Kato et al.

FOREIGN PATENT DOCUMENTS

EP 0 694 874 A2 1/1996
EP 0 977 145 A2 2/2000
EP 1 010 543 A1 6/2000
EP 1 160 915 A2 12/2001
EP 1 170 795 A2 1/2002
EP 1 280 232 A1 1/2003
EP 1 357 511 A2 10/2003
JP 50-143451 A 11/1975
JP 62-127140 U 8/1987
JP 03-262313 A 11/1991
JP 04-150011 A 5/1992
JP 04-167500 A 6/1992
JP 05-327331 A 12/1993
JP 6-53733 A 2/1994
JP 06-077729 A 3/1994
JP 06-177635 A 6/1994
JP 07-183836 A 7/1995
JP 08-056113 A 2/1996
JP 8-87580 A 4/1996
JP 11-149537 A 6/1996
JP 08-176421 A 7/1996
JP 08-180160 A 7/1996
JP 08-279027 A 10/1996
JP 08-307126 A 11/1996
JP 08-330372 A 12/1996
JP 09-014150 A 1/1997
JP 09-035025 A 2/1997
JP 09-245381 A 9/1997
JP 09-252217 A 9/1997
JP 09-270623 A 10/1997
JP 9-512367 A 12/1997
JP 10-069533 A 3/1998
JP 10-505466 A 5/1998
JP 10-171954 A 6/1998
JP 10-193849 A 7/1998
JP 10-293828 A 11/1998
JP 11-039441 A 2/1999
JP 11-075329 A 3/1999
JP 11-085937 A 3/1999
JP 11-102424 A 4/1999
JP 11-103209 A 4/1999
JP 11-149536 A 6/1999
JP 11-149538 A 6/1999
JP 11-219420 A 8/1999
JP 11-220319 A 8/1999
JP 11-328352 A 11/1999
JP 11-346114 A 12/1999
JP 11-515094 A 12/1999
JP 2000-21128 A 1/2000
JP 2000-021639 A 1/2000
JP 2000-022421 A 1/2000
JP 2005-229474 A 1/2000
JP 2000-059260 A 2/2000
JP 2000-085283 A 3/2000
JP 2000-090207 A 3/2000
JP 2000-132643 A 5/2000
JP 2000-137778 A 5/2000
JP 2000-137779 A 5/2000
JP 2000-137785 A 5/2000

| | | | |
|---|---|---|---|
| JP | 2000-148948 | A | 5/2000 |
| JP | 2000-172812 | A | 6/2000 |
| JP | 2000-222540 | A | 8/2000 |
| JP | 2000-510271 | A | 8/2000 |
| JP | 2000-243797 | A | 9/2000 |
| JP | 2000-251049 | A | 9/2000 |
| JP | 2000-276569 | A | 10/2000 |
| JP | 2000-286634 | A | 10/2000 |
| JP | 2000-286760 | A | 10/2000 |
| JP | 2000-311226 | A | 11/2000 |
| JP | 2000-321984 | A | 11/2000 |
| JP | 3075400 | U | 11/2000 |
| JP | 2000-349680 | A | 12/2000 |
| JP | 2001-028036 | A | 1/2001 |
| JP | 2007-18067 | A | 1/2001 |
| JP | 2001-043340 | A | 2/2001 |
| JP | 2001-66990 | A | 3/2001 |
| JP | 2001-505682 | A | 4/2001 |
| JP | 2001-168628 | A | 6/2001 |
| JP | 2001-188890 | A | 7/2001 |
| JP | 2001-240046 | A | 9/2001 |
| JP | 2001-256457 | A | 9/2001 |
| JP | 2001-514777 | A | 9/2001 |
| JP | 2001-319380 | A | 11/2001 |
| JP | 2001-331976 | A | 11/2001 |
| JP | 2001-332923 | A | 11/2001 |
| JP | 2001-344574 | A | 12/2001 |
| JP | 2001-351084 | A | 12/2001 |
| JP | 2001-352176 | A | 12/2001 |
| JP | 2002-024776 | A | 1/2002 |
| JP | 2002-026513 | A | 1/2002 |
| JP | 2002-042076 | A | 2/2002 |
| JP | 2002-063557 | A | 2/2002 |
| JP | 2002-505645 | A | 2/2002 |
| JP | 2002-076750 | A | 3/2002 |
| JP | 2002-76750 | A | 3/2002 |
| JP | 2002-150245 | A | 5/2002 |
| JP | 2002-158529 | A | 5/2002 |
| JP | 2002-175508 | A | 6/2002 |
| JP | 2002-183690 | A | 6/2002 |
| JP | 2002-185358 | A | 6/2002 |
| JP | 2002-204117 | A | 7/2002 |
| JP | 2002-522849 | A | 7/2002 |
| JP | 2002-230128 | A | 8/2002 |
| JP | 2002-252117 | A | 9/2002 |
| JP | 2002-259934 | A | 9/2002 |
| JP | 2002-298109 | A | 10/2002 |
| JP | 2002-308437 | A | 10/2002 |
| JP | 2002-319008 | A | 10/2002 |
| JP | 2002-319009 | A | 10/2002 |
| JP | 2002-319812 | A | 10/2002 |
| JP | 2002-362613 | A | 12/2002 |
| JP | 2002-373029 | A | 12/2002 |
| JP | 2002-373323 | A | 12/2002 |
| JP | 2002-374139 | A | 12/2002 |
| JP | 2003-006599 | A | 1/2003 |
| JP | 2003-016412 | A | 1/2003 |
| JP | 2003-026177 | A | 1/2003 |
| JP | 2003-030612 | A | 1/2003 |
| JP | 2003-44789 | A | 2/2003 |
| JP | 2003-046318 | A | 2/2003 |
| JP | 2003-58840 | A | 2/2003 |
| JP | 2003-067711 | A | 3/2003 |
| JP | 2003-069335 | A | 3/2003 |
| JP | 2003-076947 | A | 3/2003 |
| JP | 2003-078336 | A | 3/2003 |
| JP | 2003-085501 | A | 3/2003 |
| JP | 2003-085520 | A | 3/2003 |
| JP | 2003-87008 | A | 3/2003 |
| JP | 2003-87044 | A | 3/2003 |
| JP | 2003-099720 | A | 4/2003 |
| JP | 2003-099721 | A | 4/2003 |
| JP | 2003-110344 | A | 4/2003 |
| JP | 2003-132330 | A | 5/2003 |
| JP | 2003-134007 | A | 5/2003 |
| JP | 2003-155062 | A | 5/2003 |
| JP | 2003-158414 | A | 5/2003 |
| JP | 2003-187207 | A | 7/2003 |
| JP | 2003-187211 | A | 7/2003 |
| JP | 2003-188338 | A | 7/2003 |
| JP | 2003-198230 | A | 7/2003 |
| JP | 2003-209421 | A | 7/2003 |
| JP | 2003-216919 | A | 7/2003 |
| JP | 2003-218624 | A | 7/2003 |
| JP | 2003-233780 | A | 8/2003 |
| JP | 2003-242471 | A | 8/2003 |
| JP | 2003-243918 | A | 8/2003 |
| JP | 2003-249813 | A | 9/2003 |
| JP | 2003-529163 | A | 9/2003 |
| JP | 2003-288560 | A | 10/2003 |
| JP | 2003-309418 | A | 10/2003 |
| JP | 2003-317060 | A | 11/2003 |
| JP | 2003-331246 | A | 11/2003 |
| JP | 2003-332820 | A | 11/2003 |
| JP | 2004-040597 | A | 2/2004 |
| JP | 2004-082775 | A | 3/2004 |
| JP | 2004-88218 | A | 3/2004 |
| JP | 2004-096566 | A | 3/2004 |
| JP | 2004-253858 | A | 9/2004 |
| JP | 2004-527864 | A | 9/2004 |
| JP | 2004-280390 | A | 10/2004 |
| JP | 2004-287767 | A | 10/2004 |
| JP | 2004-297249 | A | 10/2004 |
| JP | 2004-297681 | A | 10/2004 |
| JP | 2004-319848 | A | 11/2004 |
| JP | 2004-326380 | A | 11/2004 |
| JP | 2004-334268 | A | 11/2004 |
| JP | 2004-336250 | A | 11/2004 |
| JP | 2004-343000 | A | 12/2004 |
| JP | 2004-362190 | A | 12/2004 |
| JP | 2004-362341 | A | 12/2004 |
| JP | 2004-362602 | A | 12/2004 |
| JP | 2005-124061 | A | 5/2005 |
| JP | 2005-129019 | A | 5/2005 |
| JP | 2005-136528 | A | 5/2005 |
| JP | 3653099 | B2 | 5/2005 |
| JP | 2005-165839 | A | 6/2005 |
| JP | 2005-167327 | A | 6/2005 |
| JP | 2005-167813 | A | 6/2005 |
| JP | 2005-190417 | A | 7/2005 |
| JP | 2005-191705 | A | 7/2005 |
| JP | 2005-210676 | A | 8/2005 |
| JP | 2005-210680 | A | 8/2005 |
| JP | 2005-217822 | A | 8/2005 |
| JP | 2005-236339 | A | 9/2005 |
| JP | 2005-244778 | A | 9/2005 |
| JP | 2005-275870 | A | 10/2005 |
| JP | 2005-284352 | A | 10/2005 |
| JP | 2005-293537 | A | 10/2005 |
| JP | 2005-295135 | A | 10/2005 |
| JP | 2005-311205 | A | 11/2005 |
| JP | 2005-321305 | A | 11/2005 |
| JP | 2005-335755 | A | 12/2005 |
| JP | 2005-346820 | A | 12/2005 |
| JP | 2005-352858 | A | 12/2005 |
| JP | 2006-025390 | A | 1/2006 |
| JP | 2006-031766 | A | 2/2006 |
| JP | 2006-39902 | A | 2/2006 |
| JP | 2006-67479 | A | 3/2006 |
| JP | 2006-72706 | A | 3/2006 |
| JP | 2006-80367 | A | 3/2006 |
| JP | 2006-92630 | A | 4/2006 |
| JP | 2006-102953 | A | 4/2006 |
| JP | 2006-107296 | A | 4/2006 |
| JP | 2006-148518 | A | 6/2006 |
| JP | 2006-151402 | A | 6/2006 |

| | | | |
|---|---|---|---|
| JP | 2006-174151 | A | 6/2006 |
| JP | 2006-195795 | A | 7/2006 |
| JP | 2006-203187 | A | 8/2006 |
| JP | 2006-203852 | A | 8/2006 |
| JP | 2006-217000 | A | 8/2006 |
| JP | 2006-232292 | A | 9/2006 |
| JP | 2006-270212 | A | 10/2006 |
| JP | 2006-285911 | A | 10/2006 |
| JP | 2006-302219 | A | 11/2006 |
| JP | 2006-309401 | A | 11/2006 |
| JP | 2006-323481 | A | 11/2006 |
| JP | 2007-007888 | A | 1/2007 |
| JP | 2007-043535 | A | 2/2007 |
| JP | 2007-048126 | A | 2/2007 |
| JP | 2007-65822 | A | 3/2007 |
| JP | 2007-096768 | A | 4/2007 |
| JP | 2007-122542 | A | 5/2007 |
| JP | 2007-150868 | A | 6/2007 |
| JP | 2007-159129 | A | 6/2007 |
| JP | 4069958 | B2 | 4/2008 |
| JP | 11-175678 | A | 1/2009 |
| NL | 9100176 | A | 3/1992 |
| NL | 9100347 | A | 3/1992 |
| WO | 99/67754 | A1 | 12/1999 |
| WO | 00/10122 | A2 | 2/2000 |
| WO | 02/061675 | A1 | 8/2002 |
| WO | 02/097723 | A1 | 12/2002 |
| WO | 03/079305 | A1 | 9/2003 |
| WO | 2004/036772 | A1 | 4/2004 |
| WO | 2004/070879 | A | 8/2004 |
| WO | 2004/072892 | A1 | 8/2004 |
| WO | 2005/073937 | A | 8/2005 |
| WO | 2005/115849 | A1 | 12/2005 |
| WO | 2006/045682 | A | 5/2006 |
| WO | 2007/083574 | A1 | 7/2007 |
| WO | 2007/125683 | A1 | 11/2007 |
| WO | 2007/138857 | A1 | 12/2007 |

OTHER PUBLICATIONS

English translation of NL9100347, published on Mar. 2, 1992.
Kato et al.: "Antenna," U.S. Appl. No. 11/928,502, filed Oct. 30, 2007.
Kato et al.: Wireless IC Device, U.S. Appl. No. 12/211,117, filed Sep. 16, 2008.
Dokai et al.: "Wireless IC Device and Component for Wireless IC Device ," U.S. Appl. No. 12/359,690, filed Jan. 26, 2009.
Kato et al.: "Electromagnetic-Coupling-Module-Attached Article," U.S. Appl. No. 11/740,509, filed Apr. 26, 2007.
Kato et al.: "Product Including Power Supply Circuit Board," U.S. Appl. No. 12/234,949, filed Sep. 22, 2008.
Kato et al.: "Data Coupler," U.S. Appl. No. 12/252,475, filed Oct. 16, 2008.
Kato et al.; "Information Terminal Device," U.S. Appl. No. 12/267,666, filed Nov. 10, 2008.
Kato et al.: "Wireless IC Device and Wireless IC Device Composite Component," U.S. Appl. No. 12/276,444, filed Nov. 24, 2008.
Dokai et al.: "Optical Disc," U.S. Appl. No. 12/326,916, filed Dec. 3, 2008.
Dokai et al.: "System for Inspecting Electromagnetic Coupling Modules and Radio IC Devices and Method for Manufacturing Electromagnetic Coupling Modules and Radio IC Devices Using the System," U.S. Appl. No. 12/274,400, filed Nov. 20, 2008.
Kato: "Wireless IC Device," U.S. Appl. No. 11/964,185, filed Dec. 26, 2007.
Kato et al.: "Radio Frequency IC Device," U.S. Appl. No. 12/336,629, filed Dec. 17, 2008.
Kato et al.: "Wireless IC Device and Component for Wireless IC Device," U.S. Appl. No. 12/339,198, filed Dec. 19, 2008.
Ikemoto et al.: "Wireless IC Device," U.S. Appl. No. 11/851,651, filed Sep. 7, 2007.
Kataya et al.: "Wireless IC Device and Electronic Device," U.S. Appl. No. 11/851,661, filed Sep. 7, 2007.
Dokai et al.: "Antenna and Radio IC Device," U.S. Appl. No. 12/350,307, filed Jan. 8, 2009.
Official communication issued in Japanese Application No. 2007-531524, mailed on Sep. 11, 2007.
Official communication issued in Japanese Application No. 2007-531525, mailed on Sep. 25, 2007.
Official communication issued in Japanese Application No. 2007-531524, mailed on Dec. 12, 2007.
Official communication issued in European Application No. 07706650.4, mailed on Nov. 24, 2008.
Mukku-Sha, "Musen IC Tagu Katsuyo-no Subete" "(All About Wireless IC Tags"), RFID, pp. 112-126.
Dokai et al.: "Wireless IC Device and Component for Wireless IC Device," U.S. Appl. No. 11/624,382, filed Jan. 18, 2007.
Dokai et al.: "Wireless IC Device, and Component for Wireless IC Device," U.S. Appl. No. 11/930,818, filed Oct. 31, 2007.
Kato et al.: "Wireless IC Device," U.S. Appl. No. 12/042,399, filed Mar. 5, 2008.
Official communication issued in related U.S. Appl. No. 12/042,399; mailed on Aug. 25, 2008.
Official communication issued in counterpart International Application No. PCT/JP2007/054242, mailed on Oct. 23, 2008.
Official communication issued in counterpart Japanese Application No. 2007-550609, mailed on Feb. 12, 2008.
Official Communication issued in International Application No. PCT/JP2007/066007, mailed on Nov. 27, 2007.
Dokai et al.: "Wireless IC Device and Component for Wireless IC Device"; U.S. Appl. No. 12/359,690, filed Jan. 26, 2009.
Dokai et al.: "Test System for Radio Frequency IC Devices and Method of Manufacturing Radio Frequency IC Devices Using the Same"; U.S. Appl. No. 12/388,826, filed Feb. 19, 2009.
Official Communication issued in International Application No. PCT/JP2008/061955, mailed on Sep. 30, 2008.
Official Communication issued in International Application No. PCT/JP2007/066721, mailed on Nov. 27, 2007.
Official Communication issued in International Application No. PCT/JP2007/070460, mailed on Dec. 11, 2007.
Kato et al.: "Wireless IC Device"; U.S. Appl. No. 12/390,556, filed Feb. 23, 2009.
Kato et al.: "Inductively Coupled Module and Item with Inductively Coupled Module"; U.S. Appl. No. 12/398,497, filed Mar. 5, 2009.
Official Communication issued in International Patent Application No. PCT/JP2008/050945, mailed on May 1, 2008.
Kato et al.: "Article Having Electromagnetic Coupling Module Attached Thereto"; U.S. Appl. No. 12/401,767, filed Mar. 11, 2009.
Taniguchi et al.: "Antenna Device and Radio Frequency IC Device"; U.S. Appl. No. 12/326,117, filed Dec. 2, 2008.
Official Communication issued in International Patent Application No. PCT/JP2008/061442, mailed on Jul. 22, 2008.
Kato et al.: "Container With Electromagnetic Coupling Module"; U.S. Appl. No. 12/426,369, filed Apr. 20, 2009.
Kato: "Wireless IC Device"; U.S. Appl. No. 12/429,346, filed Apr. 24, 2009.
Official communication issued in counterpart International Application No. PCT/JP2008/071502, mailed Feb. 24, 2009.
Kato et al.: "Wireless IC Device and Manufacturing Method Thereof," U.S. Appl. No. 12/432,854, filed Apr. 30, 2009.
Official communication issued in counterpart International Application No. PCT/JP2008/058168, mailed Aug. 12, 2008.
Official communication issued in counterpart International Application No. PCT/JP2008/062886, mailed Oct. 21, 2008.
Kato et al.: "Wireless IC Device," U.S. Appl. No. 12/469,896, filed May 21, 2009.
Ikemoto et al.: "Wireless IC Device," U.S. Appl. No. 12/496,709, filed Jul. 2, 2009.
Official communication issued in counterpart International Application No. PCT/JP2008/062947, mailed Aug. 19, 2008.
Official communication issued in counterpart International Application No. PCT/JP2008/056026, mailed Jul. 1, 2008.
Ikemoto et al.: "Wireless IC Device and Electronic Apparatus," U.S. Appl. No. 12/503,188, filed Jul. 15, 2009.
Official communication issued in counterpart International Application No. PCT/JP2008/055567, mailed May 20, 2008.

Official communication issued in counterpart International Application No. PCT/JP2008/051853, mailed Apr. 22, 2008.
Official communication issued in counterpart International Application No. PCT/JP2008/057239, mailed Jul. 22, 2008.
Kimura et al.: "Wireless IC Device," U.S. Appl. No. 12/510,338, filed Jul. 28, 2009.
Kato et al.: "Wireless IC Device," U.S. Appl. No. 12/510,340, filed Jul. 28, 2009.
Kato: "Wireless IC Device," U.S. Appl. No. 12/510,344, filed Jul. 28, 2009.
Kato et al.: "Wireless IC Device," U.S. Appl. No. 12/510,347, filed Jul. 28, 2009.
Official communication issued in counterpart European Application No. 08 77 7758, dated on Jun. 30, 2009.
Official communication issued in counterpart Japanese Application No. 2008-103741, mailed on May 26, 2009.
Official communication issued in counterpart Japanese Application No. 2008-103742, mailed on May 26, 2009.
Official communication issued in International Application No. PCT/JP2008/050358, mailed on Mar. 25, 2008.
Official communication issued in International Application No. PCT/JP2008/050356, mailed on Mar. 25, 2008.
Osamura et al.: "Packaging Material With Electromagnetic Coupling Module," U.S. Appl. No. 12/536,663, filed Aug. 6, 2009.
Osamura et al.: "Packaging Material With Electromagnetic Coupling Module," U.S. Appl. No. 12/536,669, filed Aug. 6, 2009.
Kato et al.: "Electromagnetic-Coupling-Module-Attached Article," U.S. Appl. No. 11/740,509, filed Apr. 26, 2007.
Dokai et al.: "Wireless IC Device and Component for Wireless IC Device," U.S. Appl. No. 12/543,553, filed Aug. 19, 2009.
Official communication issued in counterpart Japanese Application No. 2008-103741, mailed on May 26, 2009.
Official communication issued in counterpart Japanese Application No. 2008-103742, mailed on May 26, 2009.

* cited by examiner

| L1 | L2 |
|---|---|
| Q:100 | Q:100 |
| F:0.915GHz | F:0.915GHz |
| M:1 | M:1 |

K:0.85

| | |
|---|---|
| L1:31.21667636n | L2:160n |
| Q:50 | Q:50 |
| F:0.915GHz | F:0.915GHz |
| M:1 | M:1 |

C1:1.2p
K:0.85

| | |
|---|---|
| L1:122.0198815n | L2:50.93850328n |
| Q:50 | Q:50 |
| F:0.915GHz | F:0.915GHz |
| M:1 | M:1 |

C1:12.92465532p
C2:8.145954482p
K:0.8724937823

| | |
|---|---|
| L1:26.50626921n | L2:20.74591069n |
| Q:25 | Q:25 |
| F:0.915GHz | F:0.915GHz |
| M:1 | M:1 |

| L1a | L2 |
|---|---|
| Q:50 | Q:50 |
| F:0.915GHz | F:0.915GHz |
| M:1 | M:1 |

C2:2.985505597p

ANTENNA

BACKGROUND OF THE INVENTION

1. Field of the Invention

The present invention relates to antennas, and in particular, to a small surface-mountable broadband antenna.

2. Description of the Related Art

A helical antenna is disclosed in Japanese Unexamined Patent Application Publication No. 2003-37426 (Patent Document 1) as a small antenna that is used in mobile communication, such as cellular phones. The helical antenna enables operation in two frequency bands by winding an excitation coil around a long and narrow insulating main body in a helical fashion and winding first and second non-feeding coils around the main body in a helical fashion so that the first and second non-feeding coils are located adjacent to the excitation coil.

However, the spacing between the two frequency bands, in which the helical antenna can operate, is equal to or greater than several hundreds of megahertz, and the two frequency bands cannot be set close to each other so that the spacing is equal to or less than about 100 MHz. Moreover, although the band width of each frequency band is broad as compared to that of a helical antenna including a single coil, a sufficiently broad band width cannot be achieved.

SUMMARY OF THE INVENTION

To overcome the problems described above, preferred embodiments of the present invention provide a small antenna in which a broad band is achieved.

An antenna according to a first preferred embodiment of the present invention includes power supply terminals and at least two inductance elements that have different inductance values, wherein the inductance elements are used to radiate radio waves and are used as inductances of a matching circuit that matches an impedance when a power supply side is viewed from the power supply terminals and a radiation impedance of free space.

The at least two inductance elements, which have different inductance values, are preferably used as inductances of a matching circuit, such that the impedance of devices connected to the power supply terminals and the impedance (approximately 377 Ω) of space can be matched in a substantially broad band. Thus, a small broadband antenna is obtained, and the antenna can be surface mountable.

An antenna according to a second preferred embodiment of the present invention includes power supply terminals and a plurality of resonant circuits, wherein the plurality of resonant circuits are used to radiate radio waves and are used as inductances of a matching circuit that matches an impedance when a power supply side is viewed from the power supply terminals and a radiation impedance of free space.

Inductance components of the plurality of resonant circuits, which are used to radiate radio waves, are used as inductances of a matching circuit, such that the impedance of devices connected to the power supply terminals and the impedance (approximately 377 Ω) of space can be matched in a substantially broad band. Thus, a small broadband antenna is obtained, and the antenna can be surface mountable.

The plurality of resonant circuits may include capacitance elements and inductance elements. In this case, it is preferable that the plurality of resonant circuits be electrically directly connected to the power supply terminals or via a lumped constant capacitance or inductance. Moreover, it is preferable that a coupling coefficient between adjacent resonant circuits out of the plurality of resonant circuits be of at least about 0.1.

Moreover, the inductance elements included in the plurality of resonant circuits may be defined by a line electrode pattern in which the inductance elements are disposed in the direction of one axis. It is preferable that the capacitance elements be electrically connected to the power supply terminals for surge protection. When the capacitance elements are provided in a laminated substrate, reduction in the size is not inhibited. When the plurality of resonant circuits is provided in a laminated substrate, a reduction in the size is further facilitated, and the manufacturing is also facilitated by a lamination method.

An antenna according to a third preferred embodiment of the present invention includes first and second power supply terminals and a plurality of resonant circuits. The antenna includes a first LC series resonant circuit that includes a first inductance element and first and second capacitance elements that are electrically connected to both ends of the first inductance element, and a second LC series resonant circuit that includes a second inductance element and third and fourth capacitance elements that are electrically connected to both ends of the second inductance element, wherein the first and second inductance elements are magnetically coupled together, one end of the first inductance element is electrically connected to the first power supply terminal via the first capacitance element, and the other end is electrically connected to the second power supply terminal via the second capacitance element, and one end of the second inductance element is electrically connected to the first power supply terminal via the third and first capacitance elements, and the other end is electrically connected to the second power supply terminal via the fourth and second capacitance elements.

In the antenna according to the third preferred embodiment, the first and second LC series resonant circuits are used to radiate radio waves, and the first and second inductance elements function as inductances of a matching circuit, such that the impedance of devices connected to the first and second power supply terminals and the impedance (approximately 377 Ω) of space can be matched in a substantially broad band. Moreover, the individual elements can be readily constructed in a laminate. Thus, a small surface-mountable broadband antenna is obtained.

According to preferred embodiments of the present invention, the impedance of devices connected to power supply terminals and the impedance (approximately 377 Ω) of space can be matched in a substantially broad band using a plurality of inductance elements or a plurality of resonant circuits, which are used to radiate radio waves, and a small broadband antenna is obtained without providing a matching circuit separately.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

Antennas according to preferred embodiments of the present invention will now be described with reference to the drawings.

First Preferred Embodiment

Figure 1:
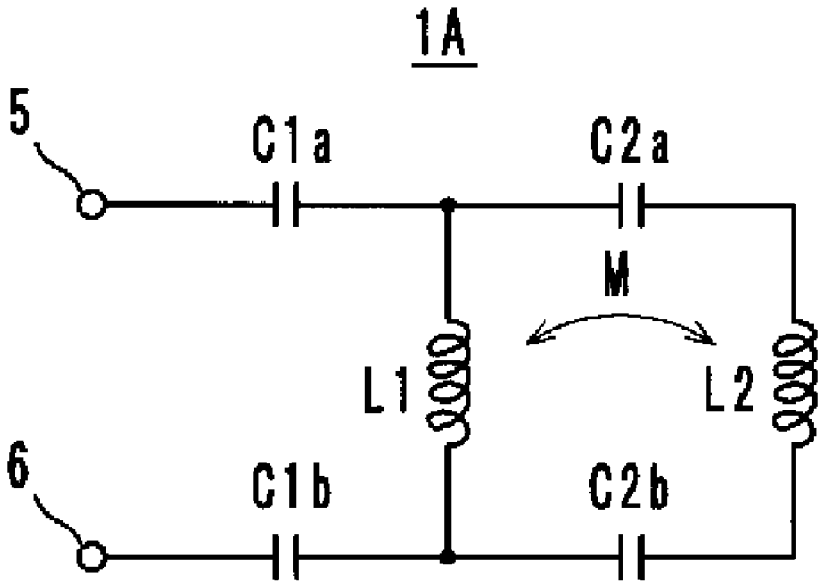
FIG. 1 is an equivalent circuit diagram of an antenna according to a first preferred embodiment of the present invention.

An antenna 1A according to a first preferred embodiment includes inductance elements L1 and L2 that have different inductance values and are magnetically coupled together in phase (indicated by a mutual inductance M), as shown as an equivalent circuit in FIG. 1. The inductance element L1 is connected to power supply terminals 5 and 6 via capacitance elements C1*a* and C1*b*, and is connected in parallel with the inductance element L2 via capacitance elements C2*a* and C2*b*. That is to say, this resonant circuit includes an LC series resonant circuit that includes the inductance element L1 and the capacitance elements C1*a* and C1*b* and an LC series resonant circuit that includes the inductance element L2 and the capacitance elements C2*a* and C2*b*.

Figure 2:
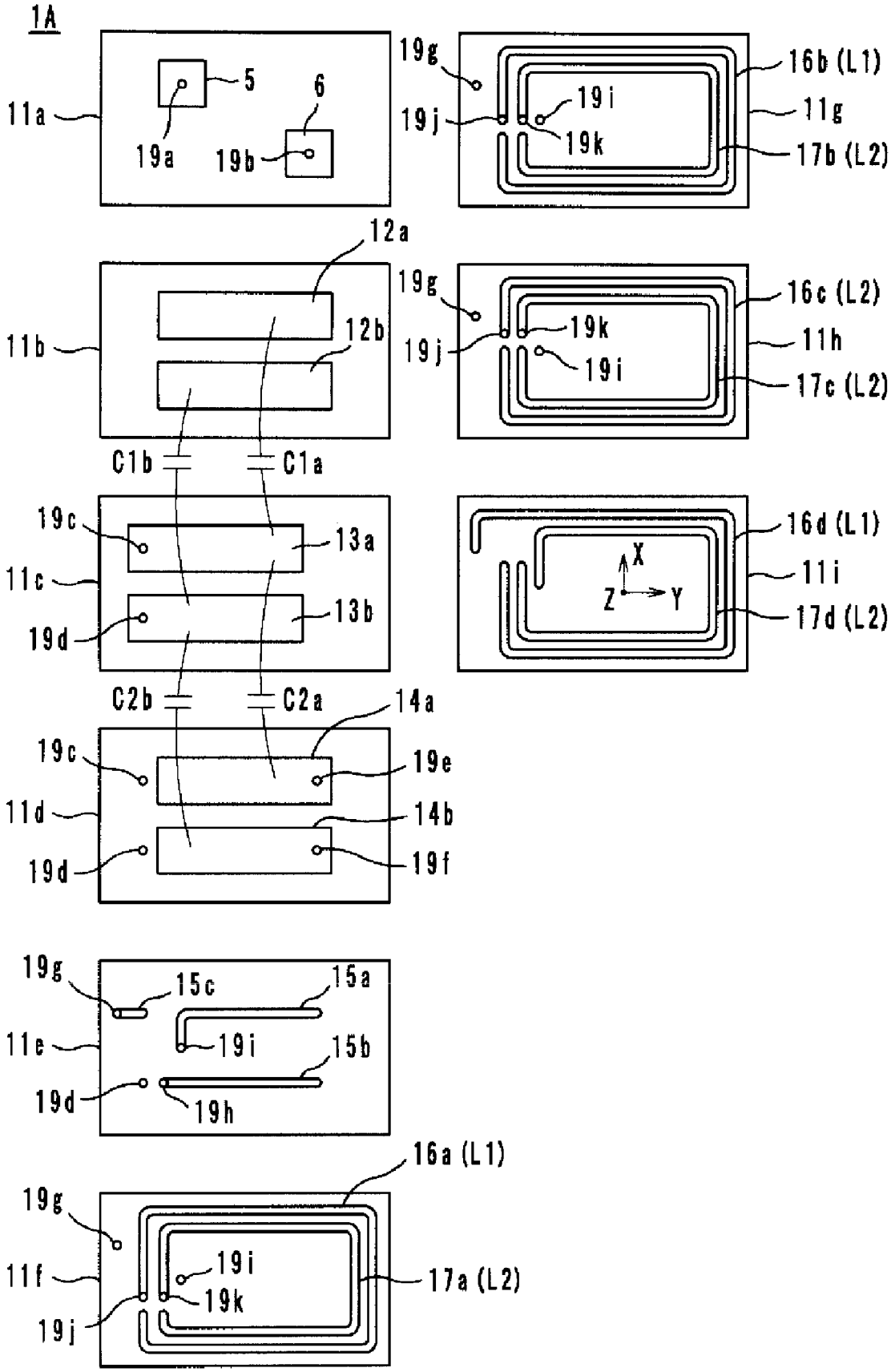
FIG. 2 is a plan view showing a laminated structure of the antenna according to the first preferred embodiment of the present invention.

The antenna 1A having the aforementioned circuit configuration is defined by a laminate shown as an example in FIG. 2, and includes ceramic sheets 11*a* to 11*i* of dielectric material that are laminated, pressure bonded, and fired together. That is to say, the power supply terminals 5 and 6 and via-hole conductors 19*a* and 19*b* are provided in the sheet 11*a*, capacitor electrodes 12*a* and 12*b* are provided in the sheet 11*b*, capacitor electrodes 13*a* and 13*b* and via-hole conductors 19*c* and 19*d* are provided in the sheet 11*c*, and capacitor electrodes 14*a* and 14*b*, the via-hole conductors 19*c* and 19*d*, and via-hole conductors 19*e* and 19*f* are provided in the sheet 11*d*.

Moreover, connecting conductor patterns 15*a*, 15*b*, and 15*c*, the via-hole conductor 19*d*, and via-hole conductors 19*g*, 19*h*, and 19*i* are provided in the sheet 11*e*. Conductor patterns 16*a* and 17*a*, the via-hole conductors 19*g* and 19*i*, and via-hole conductors 19*j* and 19*k* are provided in the sheet 11*f*. Conductor patterns 16*b* and 17*b* and the via-hole conductors 19*g*, 19*i*, 19*j*, and 19*k* are provided in the sheet 11*g*. Conductor patterns 16*c* and 17*c* and the via-hole conductors 19*g*, 19*i*,

19*j*, and 19*k* are provided in the sheet 11*h*. Moreover, conductor patterns 16*d* and 17*d* are provided in the sheet 11*i*.

When the aforementioned sheets 11*a* to 11*i* are laminated together, the conductor patterns 16*a* to 16*d* are connected together via the via-hole conductor 19*j*, so that the inductance element L1 is formed, and the conductor patterns 17*a* to 17*d* are connected together via the via-hole conductor 19*k*, so that the inductance element L2 is formed. The capacitance element C1*a* is defined by the electrodes 12*a* and 13*a*, and the capacitance element C1*b* is defined the electrodes 12*b* and 13*b*. Moreover, the capacitance element C2*a* is defined by the electrodes 13*a* and 14*a*, and the capacitance element C2*b* is defined by the electrodes 13*b* and 14*b*.

One end of the inductance element L1 is connected to the capacitor electrode 13*a* via the via-hole conductor 19*g*, the connecting conductor pattern 15*c*, and the via-hole conductor 19*c*, and the other end is connected to the capacitor electrode 13*b* via the via-hole conductor 19*d*. One end of the inductance element L2 is connected to the capacitor electrode 14*a* via the via-hole conductor 19*i*, the connecting conductor pattern 15*a*, and the via-hole conductor 19*e*, and the other end is connected to the capacitor electrode 14*b* via the via-hole conductor 19*h*, the connecting conductor pattern 15*b*, and the via-hole conductor 19*f*.

Moreover, the power supply terminal 5 is connected to the capacitor electrode 12*a* via the via-hole conductor 19*a*, and the power supply terminal 6 is connected to the capacitor electrode 12*b* via the via-hole conductor 19*b*.

In the antenna 1A having the aforementioned structure, the LC series resonant circuits, which respectively include the inductance elements L1 and L2 magnetically coupled together, resonate, and the inductance elements L1 and L2 function as a radiating element. Moreover, the inductance elements L1 and L2 are coupled together via the capacitance elements C2*a* and C2*b*, so that the LC series resonant circuits function as a matching circuit that matches the impedance (approximately 50 Ω) of devices connected to the power supply terminals 5 and 6 and the impedance (approximately 377 Ω) of space.

The coupling coefficient k between the adjacent inductance elements L1 and L2 is expressed by $k^2=M^2(L1\times L2)$ and is preferably equal to or greater than about 0.1. In the first preferred embodiment, the coupling coefficient k is about 0.8975. The inductance values of the inductance elements L1 and L2 and the degree (the mutual inductance M) of the magnetic coupling between the inductance elements L1 and L2 are set so that a desired band width can be obtained. Moreover, since the LC resonant circuits, which include the capacitance elements C1*a*, C1*b*, C2*a*, and C2*b* and the inductance elements L1 and L2, are constructed as a lumped constant resonant circuit, the LC resonant circuits can be manufactured in a small size as a laminate, so that the LC resonant circuits are less influenced by other elements. Moreover, since the capacitance elements C1*a* and C1*b* intervene for the power supply terminals 5 and 6, a surge in low frequencies is prevented, so that the device can be protected against the surge.

Moreover, since the plurality of LC series resonant circuits include a laminated substrate, the plurality of LC series resonant circuits can be manufactured as a small antenna that can be mounted on a surface of a substrate, for example, a cellular phone and can be also used as an antenna for a radio IC device that is used in a Radio Frequency Identification (RFID) system.

Figure 3:
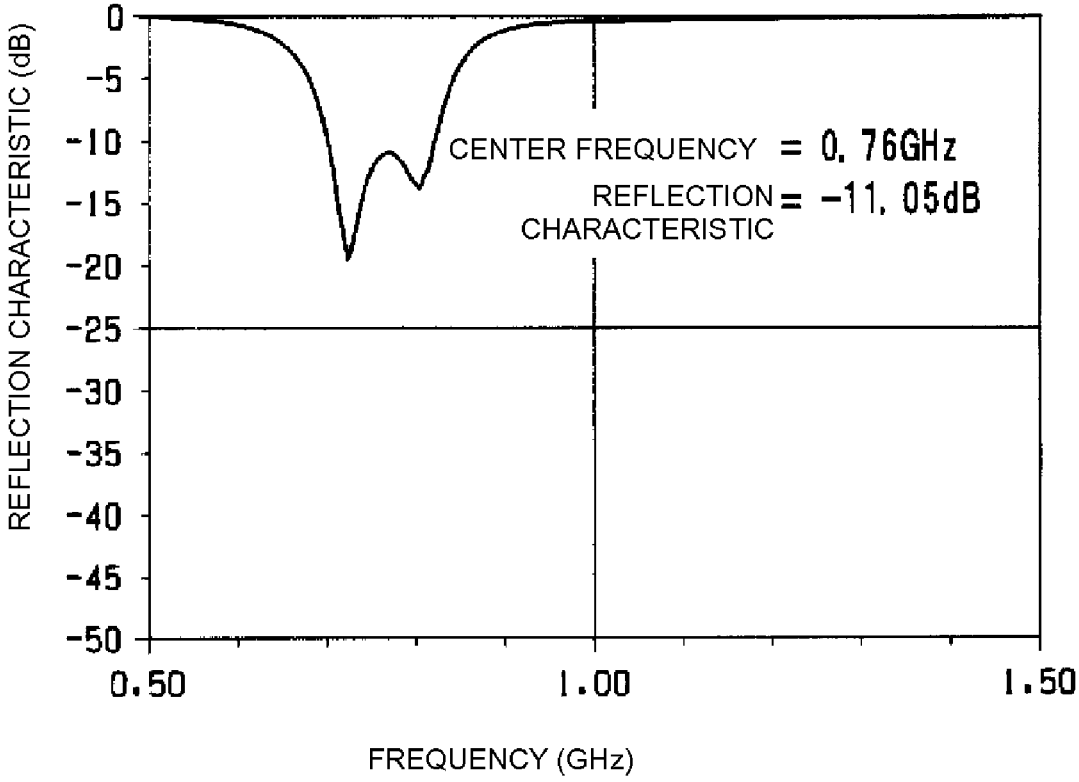
FIG. 3 is a graph showing reflection characteristics of the antenna according to the first preferred embodiment of the present invention.

As the result of a simulation performed by the inventor using the equivalent circuit shown in FIG. 1, in the antenna 1A, the reflection characteristics shown in FIG. 3 were obtained. As shown in FIG. 3, the center frequency was about 760 MHz, and reflection characteristics of about −10 dB or less were obtained in a broad band of about 700 MHz to about 800 MHz. The reason why reflection characteristics are obtained in a broad band is described in detail in a second preferred embodiment described below.

Figure 4:
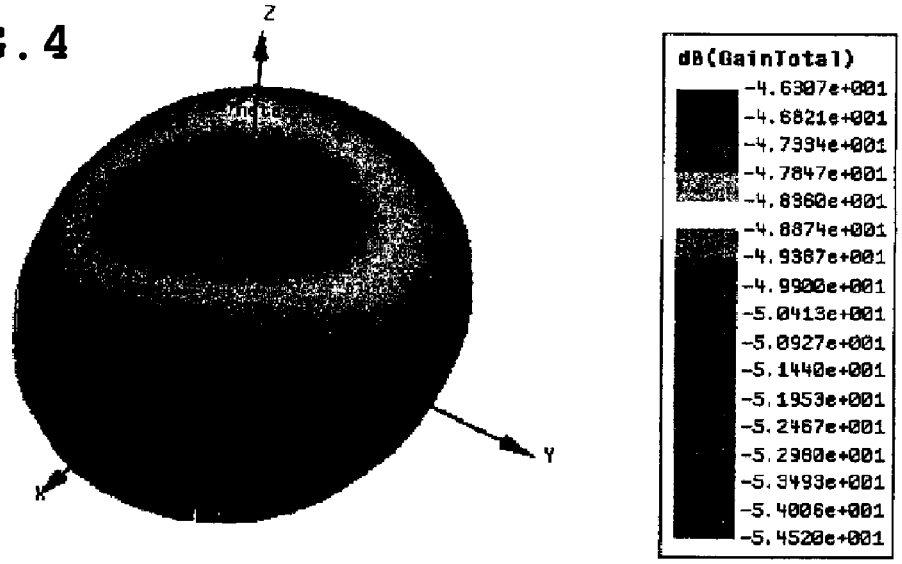
FIG. 4 is a graph showing directivity of the antenna according to the first preferred embodiment of the present invention.
Figure 5:
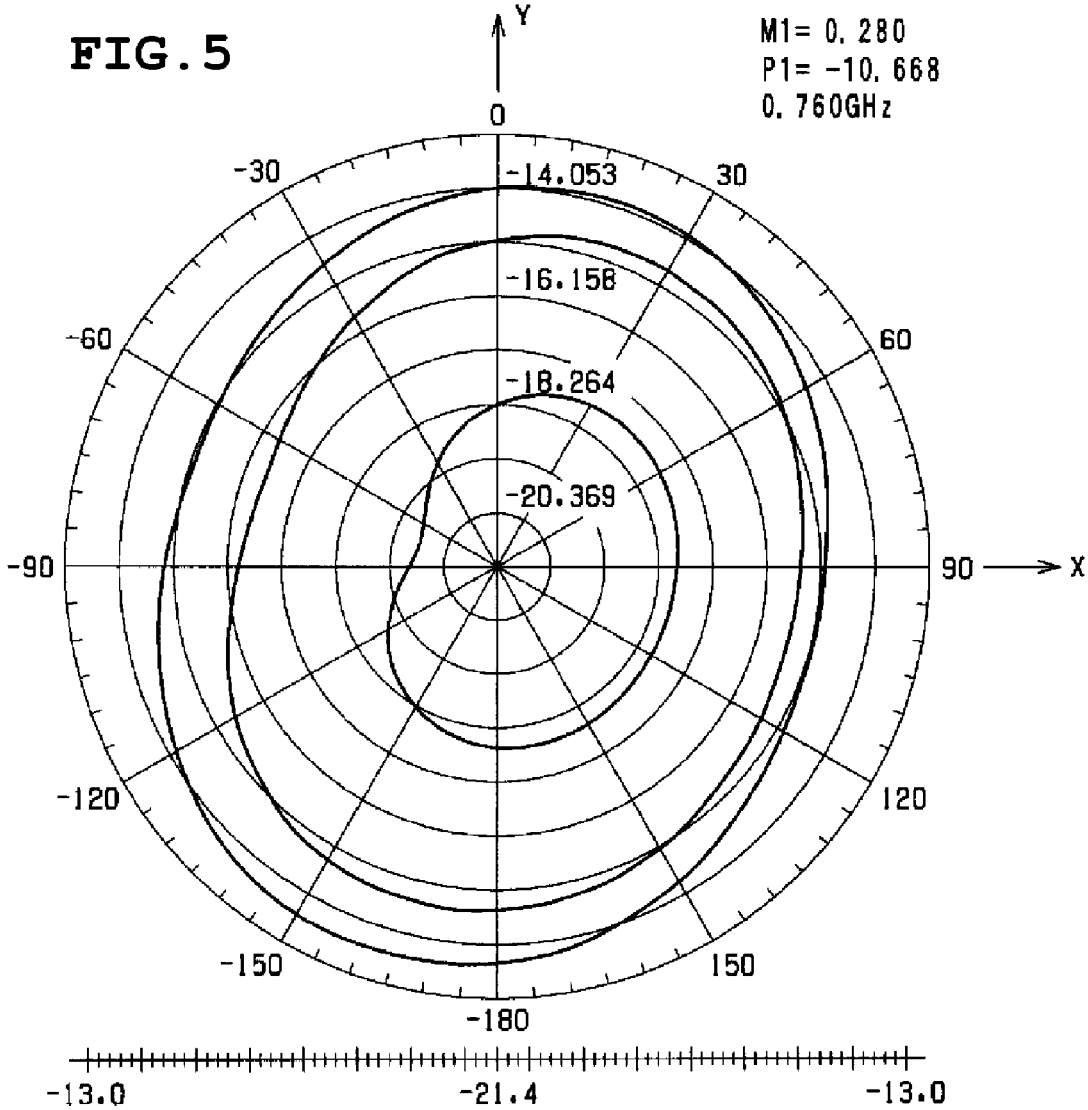
FIG. 5 is a chart of the X-Y plane showing directivities of the antenna according to the first preferred embodiment of the present invention.
Figure 6:
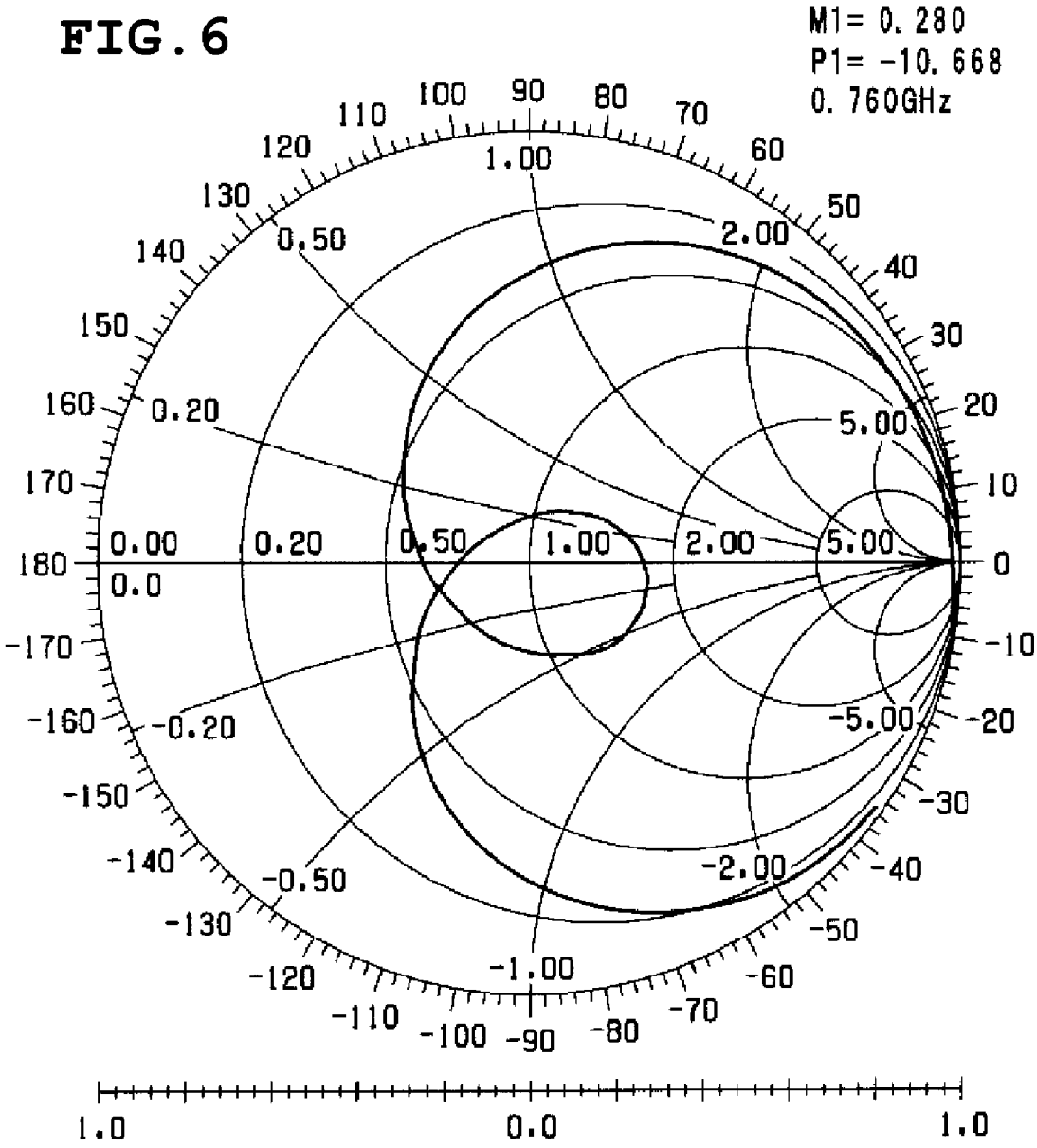
FIG. 6 is a Smith chart showing impedances of the antenna according to the first preferred embodiment of the present invention.

The directivity of the antenna 1A is shown in FIG. 4, and the directivity in the X-Y plane is shown in FIG. 5. The X axis, the Y axis, and the Z axis correspond to arrows X, Y, and Z shown in FIGS. 2 and 4, respectively. FIG. 6 is a Smith chart showing impedances.

Second Preferred Embodiment

Figure 7:
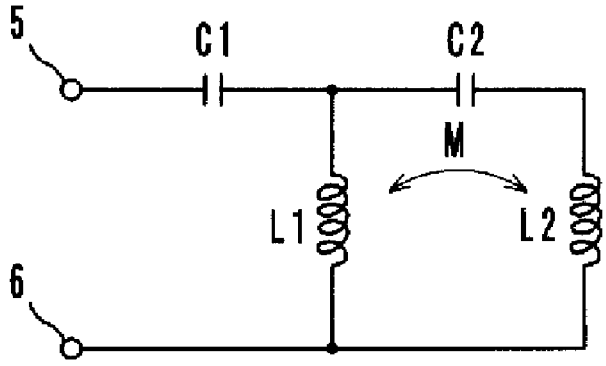
FIG. 7 is an equivalent circuit diagram of an antenna according to a second preferred embodiment of the present invention.

An antenna 1B according to a second preferred embodiment includes the inductance elements L1 and L2, which have different inductance values and are magnetically coupled together in phase (indicated by the mutual inductance M), as shown as an equivalent circuit in FIG. 7. One end of the inductance element L1 is connected to the power supply terminal 5 via a capacitance element C1, and is connected to the inductance element L2 via a capacitance element C2. Moreover, the other ends of the inductance elements L1 and L2 are connected directly to the power supply terminal 6. That is to say, this resonant circuit includes an LC series resonant circuit that includes the inductance element L1 and the capacitance element C1 and an LC series resonant circuit that includes the inductance element L2 and the capacitance element C2, and is substantially the same as the antenna 1A according to the first preferred embodiment, the capacitance elements C1*b* and C2*b* being omitted from the antenna 1A. The inductance values of the inductance elements L1 and L2 and the degree (the mutual inductance M) of the magnetic coupling between the inductance elements L1 and L2 are set such that a desired band width is obtained.

Figure 8:
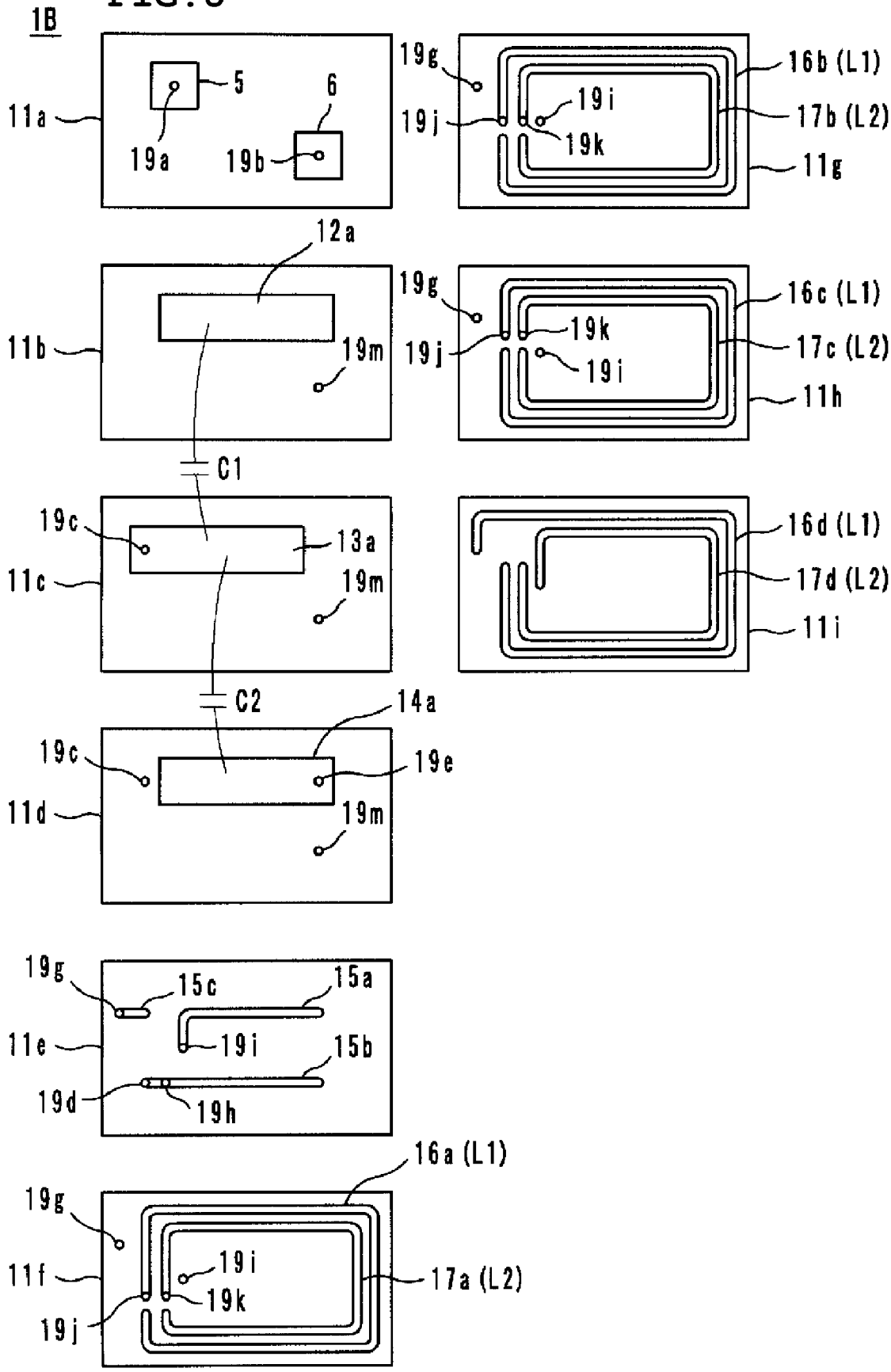
FIG. 8 is a plan view showing a laminated structure of the antenna according to the second preferred embodiment of the present invention.

The antenna 1B having the aforementioned circuit configuration is formed as a laminate shown as an example in FIG. 8, and is composed of the ceramic sheets 11*a* to 11*i* of dielectric material that are laminated, pressure bonded, and fired together. That is to say, the power supply terminals 5 and 6 and the via-hole conductors 19*a* and 19*b* are provided in the sheet 11*a*, the capacitor electrode 12*a* and a via-hole conductor 19*m* are provided in the sheet 11*b*, the capacitor electrode 13*a* and the via-hole conductors 19*c* and 19*m* are provided in the sheet 11*c*, and the capacitor electrode 14*a* and the via-hole conductors 19*c*, 19*e*, and 19*m* are provided in the sheet 11*d*.

Moreover, the connecting conductor patterns 15*a*, 15*b*, and 15*c* and the via-hole conductors 19*d*, 19*g*, 19*h*, and 19*i* are provided in the sheet 11*e*. The conductor patterns 16*a* and 17*a* and the via-hole conductors 19*g*, 19*i*, 19*j*, and 19*k* are provided in the sheet 11*f*. The conductor patterns 16*b* and 17*b* and the via-hole conductors 19*g*, 19*i*, 19*j*, and 19*k* are provided in the sheet 11*g*. The conductor patterns 16*c* and 17*c* and the via-hole conductors 19*g*, 19*i*, 19*j*, and 19*k* are provided in the sheet 11*h*. Moreover, the conductor patterns 16*d* and 17*d* are provided in the sheet 11*i*.

When the aforementioned sheets 11*a* to 11*i* are laminated together, the conductor patterns 16*a* to 16*d* are connected together via the via-hole conductor 19*j*, so that the inductance element L1 is provided, and the conductor patterns 17*a* to 17*d* are connected together via the via-hole conductor 19*k*, so that the inductance element L2 is provided. The capacitance element C1 is defined by the electrodes 12*a* and 13*a*, and the capacitance element C2 is defined by the electrodes 13*a* and 14*a*.

One end of the inductance element L1 is connected to the capacitor electrode 13*a* via the via-hole conductor 19*g*, the connecting conductor pattern 15*c*, and the via-hole conductor 19*c*, and the other end is connected to the power supply terminal 6 via the via-hole conductor 19*d*, the connecting conductor pattern 15*b*, and the via-hole conductors 19*m* and 19*b*. The capacitor electrode 12*a* is connected to the power supply terminal 5 via the via-hole conductor 19*a*.

On the other hand, one end of the inductance element L2 is connected to the capacitor electrode 14*a* via the via-hole conductor 19*i*, the connecting conductor pattern 15*a*, and the via-hole conductor 19*e*, and the other end is connected to the power supply terminal 6 via the via-hole conductor 19*h*, the connecting conductor pattern 15*b*, and the via-hole conductors 19*m* and 19*b*. The other ends of the inductance elements L1 and L2 are connected via the connecting conductor pattern 15*b*.

In the antenna 1B having the aforementioned structure, the LC series resonant circuits, which respectively include the inductance elements L1 and L2 magnetically coupled together, resonate, and the inductance elements L1 and L2 function as a radiating element. Moreover, the inductance elements L1 and L2 are coupled together via the capacitance element C2, so that the LC series resonant circuits function as a matching circuit that matches the impedance (approximately 50 Ω) of devices connected to the power supply terminals 5 and 6 and the impedance (approximately 377 Ω) of space.

Figure 9:
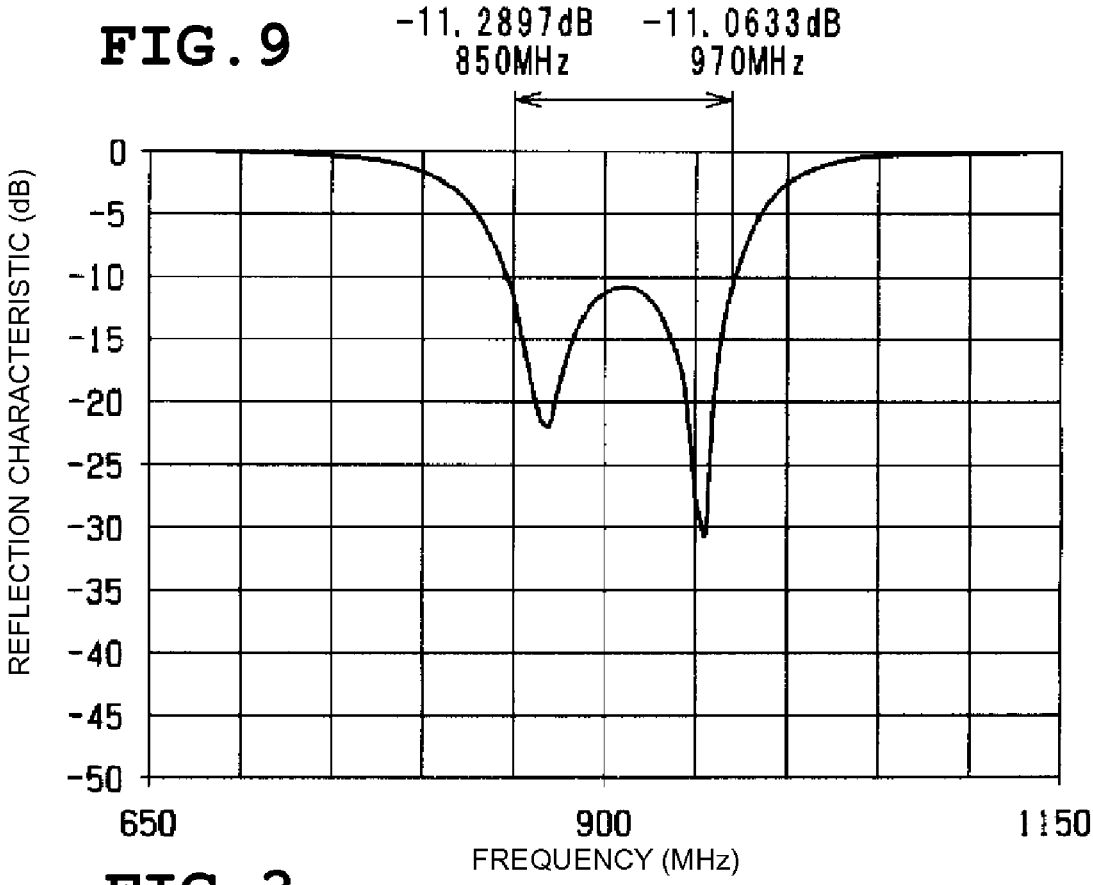
FIG. 9 is a graph showing reflection characteristics of the antenna according to the second preferred embodiment of the present invention.

As the result of a simulation performed by the inventor using the equivalent circuit shown in FIG. 7, in the antenna 1B, reflection characteristics shown in FIG. 9 were obtained.

Figure 10A:
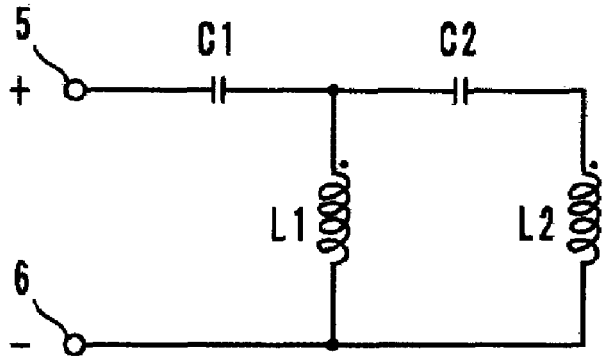
FIGS. 10A to 10C show equivalent circuit diagrams of the antenna according to the second preferred embodiment of the present invention, obtained by transformation of a circuit.
Figure 10B:
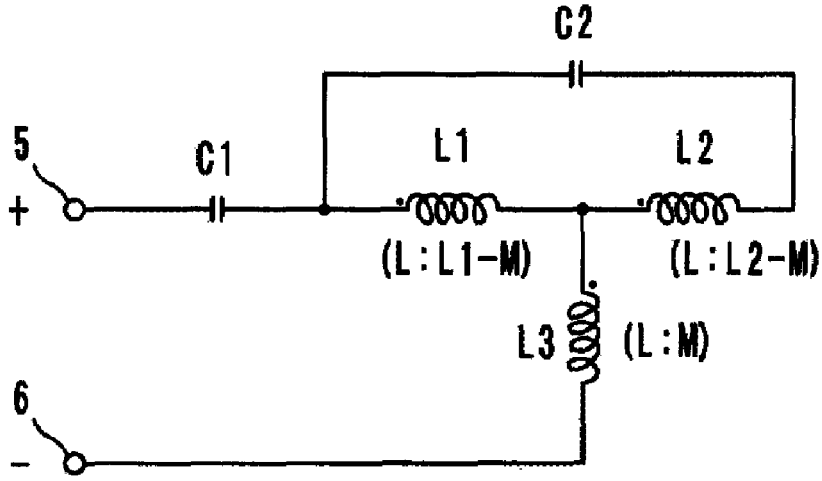
Figure 10C:
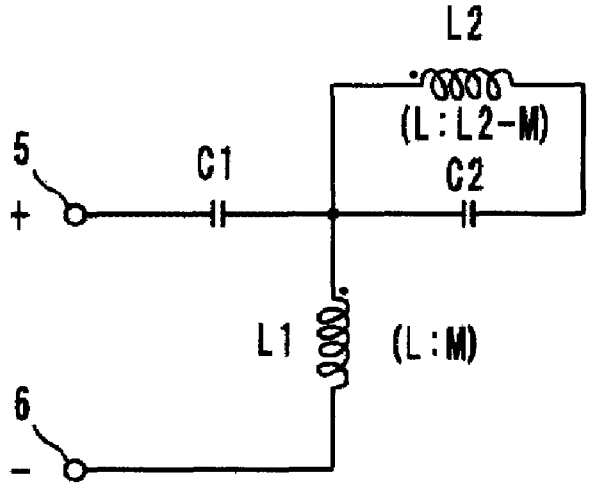

The reason why reflection characteristics can be obtained in a broad band in the antenna 1B according to the second preferred embodiment will now be described in detail. Referring to FIG. 10A shows the circuit configuration of the antenna 1B. FIG. 10B shows a circuit configuration in which a π circuit part that includes the inductance element L1, the capacitance element C2, and the inductance element L2 in Part (A) is transformed into a T circuit. In FIG. 10B, when L1<L2, L1−LM≦0 because of the value of the mutual inductance M. In this case, when L1−M=0, the circuit shown in FIG. 10B can be transformed into a circuit shown in FIG. 10C. When L1−M<0, the capacitance C2 in the circuit shown in FIG. 10C is C2'. The circuit shown in FIG. 10C obtained by the transformation of the circuit includes a series resonant circuit that includes the capacitance C1 and the mutual inductance M and a parallel resonant circuit that includes the capacitance C2 and the inductance L2−M. Thus, a broad band can be achieved by expanding the band width by increasing the spacing between resonant frequencies of the individual resonant circuits. The band width is appropriately set via the individual resonant frequencies, i.e., the values of L1, L2, and M.

Third Preferred Embodiment

Figure 11:
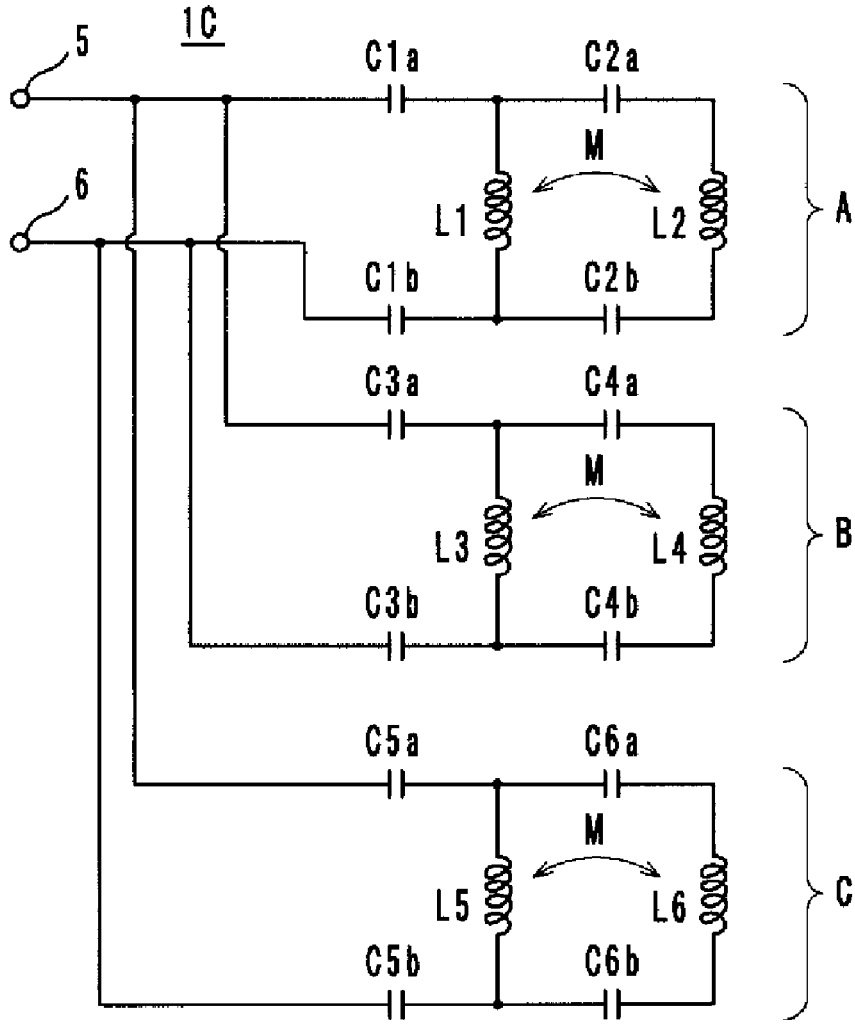
FIG. 11 is an equivalent circuit diagram of an antenna according to a third preferred embodiment of the present invention.

An antenna 1C according to a third preferred embodiment includes blocks A, B, and C, each of which includes two LC series resonant circuits, as shown as an equivalent circuit in FIG. 11. The LC series resonant circuits included in each of the blocks A, B, and C have the same circuit configuration as the antenna 1A according to the first preferred embodiment, and the detailed description is omitted.

Figure 12:
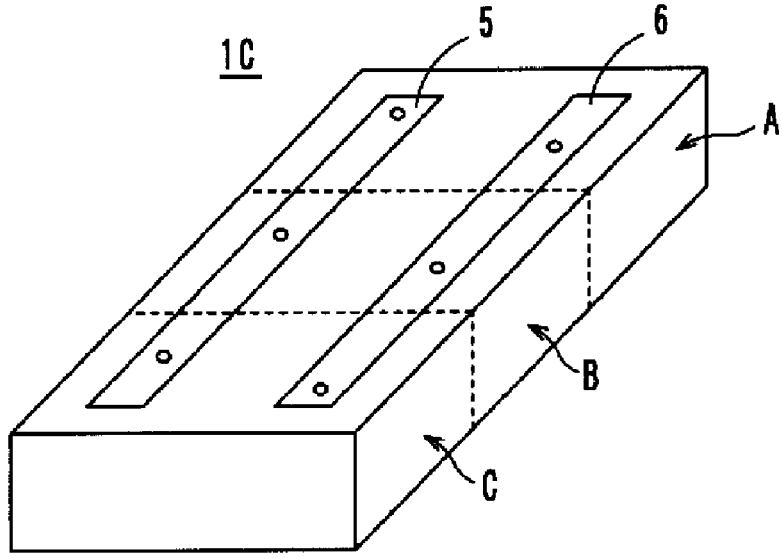
FIG. 12 is a perspective view showing an external view of the antenna according to the third preferred embodiment of the present invention.

In the antenna 1C, laminates, each shown in FIG. 2, are disposed in parallel as the blocks A, B, and C, and the LC series resonant circuits in each of the blocks A, B, and C are connected to the common power supply terminals 5 and 6, as shown in FIG. 12.

In the antenna 1C having the aforementioned structure, the LC series resonant circuits, which respectively include the inductance elements L1 and L2, inductance elements L3 and L4, and inductance elements L5 and L6, magnetically coupled together, resonate and function as a radiating element. Moreover, the inductance elements are coupled together via the capacitance elements, so that the LC series resonant circuits function as a matching circuit that matches the impedance (approximately 50 Ω) of devices connected to the power supply terminals 5 and 6 and the impedance (approximately 377 Ω) of space.

Figure 13:
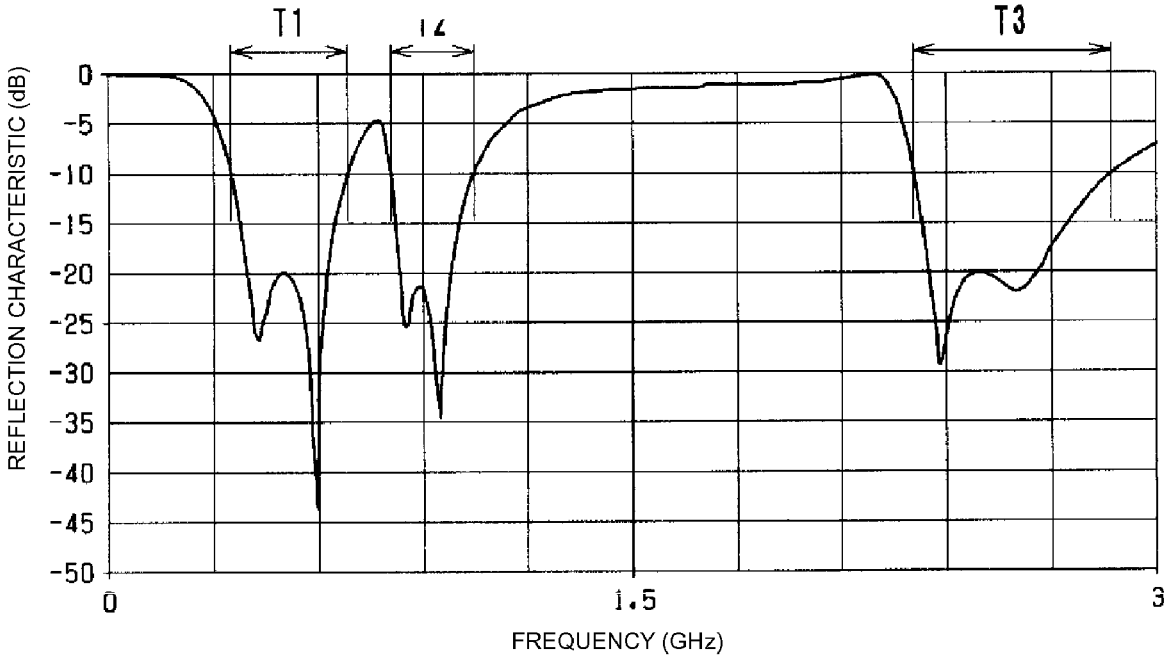
FIG. 13 is a graph showing reflection characteristics of the antenna according to the third preferred embodiment of the present invention.

That is to say, the antenna 1C according to the third preferred embodiment is the same as three pieces of the antenna 1A according to the first preferred embodiment, connected in parallel. As the result of a simulation performed by the inventor using the equivalent circuit shown in FIG. 11, reflection characteristics of about −10 dB or less were obtained in three frequency bands T1, T2, and T3, as shown in FIG. 13. The bands T1, T2, and T3 correspond to UHF television, GSM, and a wireless LAN, respectively. The other operations and effects in the third preferred embodiment are similar to those in the aforementioned first preferred embodiment.

Fourth Preferred Embodiment

Figure 14:
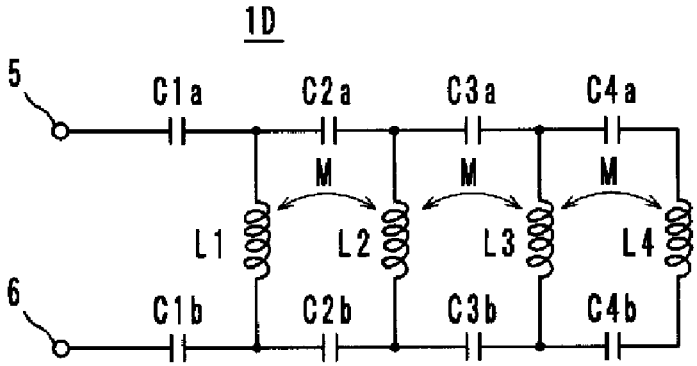
FIG. 14 is an equivalent circuit diagram of an antenna according to a fourth preferred embodiment of the present invention.

An antenna 1D according to a fourth preferred embodiment includes the inductance elements L1, L2, L3, and L4, which have different inductance values and are magnetically coupled together in phase (indicated by the mutual inductance M), as shown as an equivalent circuit in FIG. 14. The inductance element L1 is connected to the power supply terminals 5 and 6 via the capacitance elements C1*a* and C1*b*, and is connected in parallel with the inductance element L2 via the capacitance elements C2*a* and C2*b*, the inductance element L3 via capacitance elements C3*a* and C3*b*, and the inductance element L4 via the capacitance elements C4*a* and C4*b*. That is to say, this resonant circuit includes an LC series resonant circuit that includes the inductance element L1 and the capacitance elements C1*a* and C1*b*, an LC series resonant circuit that includes the inductance element L2 and the capacitance elements C2*a* and C2*b*, an LC series resonant circuit that includes the inductance element L3 and the capacitance elements C3*a* and C3*b*, and an LC series resonant circuit that includes the inductance element L4 and the capacitance elements C4*a* and C4*b*.

Figure 15:
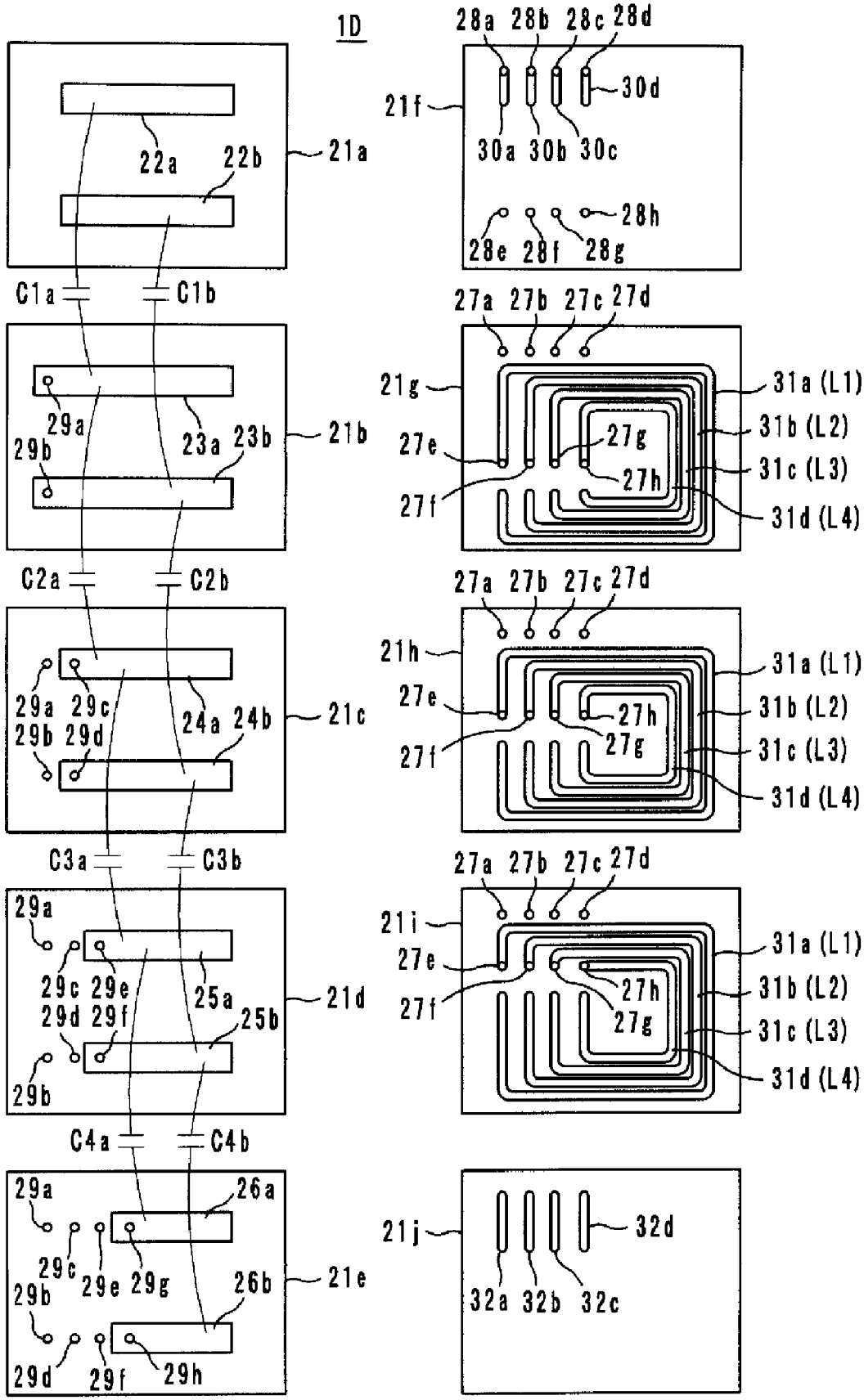
FIG. 15 is a plan view showing a laminated structure of the antenna according to the fourth preferred embodiment of the present invention.

The antenna 1D having the aforementioned circuit configuration is formed as a laminate shown as an example in FIG. 15, and is composed of ceramic sheets 21*a* to 21*j* of dielectric material that are laminated, pressure bonded, and fired together. That is to say, capacitor electrodes 22*a* and 22*b* that also function as the power supply terminals 5 and 6 are provided in the sheet 21*a*, capacitor electrodes 23*a* and 23*b* and via-hole conductors 29*a* and 29*b* are provided in the sheet 21*b*, capacitor electrodes 24*a* and 24*b* and via-hole conductors 29*a* to 29*d* are provided in the sheet 21*c*. Capacitor electrodes 25*a* and 25*b*, the via-hole conductors 29*a* to 29*f*, and via-hole conductors 29*e* and 29*f* are provided in the sheet 21*d*, and capacitor electrodes 26*a* and 26*b* and via-hole conductors 29*a* to 29*h* are provided in the sheet 21*e*.

Moreover, connecting conductor patterns 30*a* to 30*d* and via-hole conductors 28*a* to 28*h* are provided in the sheet 21*f*. Conductor patterns 31*a* to 31*d* and via-hole conductors 27*a* to 27*h* are provided in the sheet 21*g*. The conductor patterns 31*a* to 31*d* and the via-hole conductors 27*a* to 27*h* are provided in the sheet 21*h*. The conductor patterns 31*a* to 31*d* and the via-hole conductors 27*a* to 27*h* are provided in the sheet 21*i*. Moreover, connecting conductor patterns 32*a* to 32*d* are provided in the sheet 21*j*.

When the aforementioned sheets 21*a* to 21*j* are laminated together, the individual conductor patterns 31*a* to 31*d* are connected via the via-hole conductors 27*e* to 27*h*, respectively, so that the inductance elements L1 to L4 are formed. One end of the inductance element L1 is connected to the capacitor electrode 23*a* via the via-hole conductor 27*e*, the connecting conductor pattern 32*a*, the via-hole conductors 27*a* and 28*a*, the connecting conductor pattern 30*a* and the via-hole conductor 29*a*. The other end of the inductance element L1 is connected to the capacitor electrode 23*b* via the via-hole conductors 28*e* and 29*b*. One end of the inductance element L2 is connected to the capacitor electrode 24*a* via the via-hole conductor 27*f*, the connecting conductor pattern 32*b*, the via-hole conductors 27*b* and 28*b*, the connecting conductor pattern 30*b* and the via-hole conductor 29*c*. The other end of the inductance element L2 is connected to the capacitor electrode 24*b* via the via-hole conductors 28*f* and 29*d*.

Moreover, one end of the inductance element L3 is connected to the capacitor electrode 25*a* via the via-hole conductor 27*g*, the connecting conductor pattern 32*c*, the via-hole conductors 27*c* and 28*c*, the connecting conductor pattern 30*c* and the via-hole conductor 29*e*. The other end of the inductance element L3 is connected to the capacitor electrode 25*b* via the via-hole conductors 28*g* and 29*f*. One end of the inductance element L4 is connected to the capacitor electrode 26*a* via the via-hole conductor 27*h*, the connecting conductor pattern 32*d*, the via-hole conductors 27*d* and 28*d*, the connecting conductor pattern 30*d* and the via-hole conductor 29*g*. The other end of the inductance element L4 is connected to the capacitor electrode 26*b* via the via-hole conductors 28*h* and 29*h*.

The capacitance element C1*a* is defined by the electrodes 22*a* and 23*a*, and the capacitance element C1*b* is defined by the electrodes 22*b* and 23*b*. The capacitance element C2*a* is defined by the electrodes 23*a* and 24*a*, and the capacitance element C2*b* is defined by the electrodes 23*b* and 24*b*. Moreover, the capacitance element C3*a* is defined by the electrodes 24*a* and 25*a*, and the capacitance element C3*b* is defined by the electrodes 24*b* and 25*b*. The capacitance element C4*a* is defined by the electrodes 25*a* and 26*a*, and the capacitance element C4*b* is defined by the electrodes 25*b* and 26*b*.

In the antenna 1D having the aforementioned structure, the LC series resonant circuits, which respectively include the inductance elements L1 to L4 magnetically coupled together, resonate, and the inductance elements L1 to L4 function as a radiating element. Moreover, the inductance elements L1 to L4 are coupled together via the capacitance elements C2*a*, C2*b*, C3*a*, C3*b*, C4*a*, and C4*b*, so that the LC series resonant circuits function as a matching circuit that matches the impedance (generally 50 Ω) of devices connected to the power supply terminals 5 and 6 and the impedance (377 Ω) of space.

The coupling coefficient k1 between the adjacent inductance elements L1 and L2, the coupling coefficient k2 between the inductance elements L2 and L3, and the coupling coefficient k3 between the inductance elements L3 and L4 are expressed by $k1^2=M^2(L1\times L2)$, $k2^2=M^2(L2\times L3)$, and $k3^2=M^2(L3\times L4)$, respectively, and are preferably equal to or more than 0.1. In the fourth preferred embodiment, k1, k2, and k3 are about 0.7624, 0.5750, and 0.6627, respectively. The inductance values of the inductance elements L1 to L4 and the values of the coupling coefficients k1, k2, and k3 are set so that a desired band width is obtained.

Figure 16:
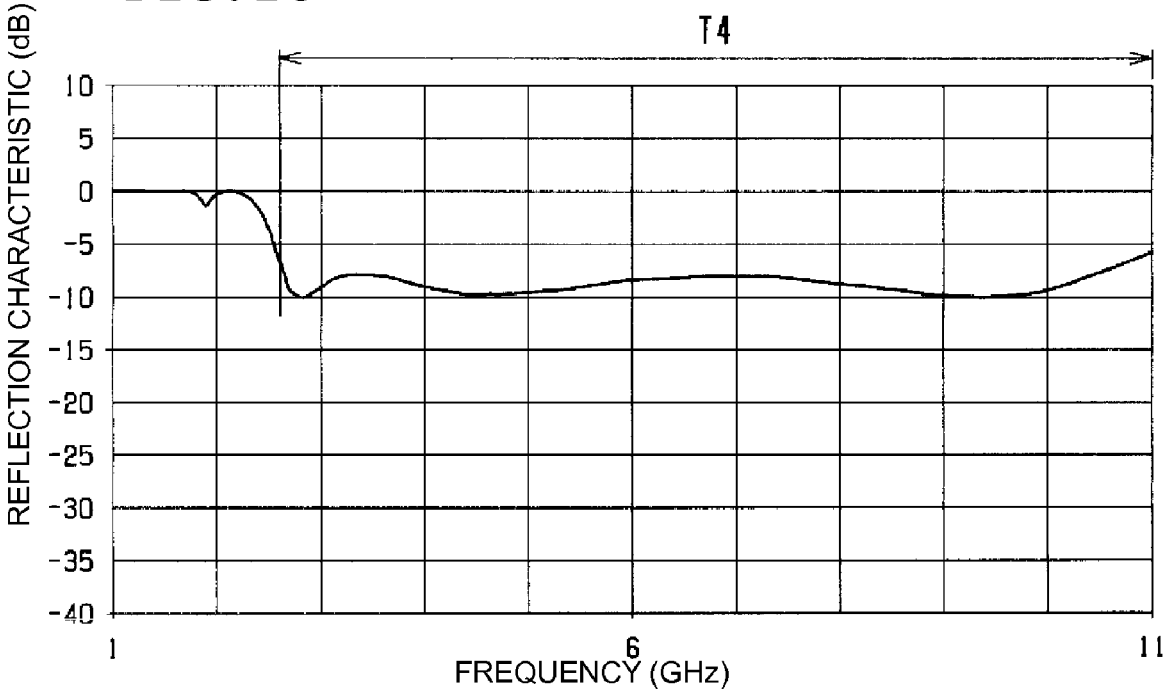
FIG. 16 is a graph showing reflection characteristics of the antenna according to the fourth preferred embodiment of the present invention.

As a result of a simulation performed by the inventor using the equivalent circuit shown in FIG. 14, in the antenna 1D, reflection characteristics of about −6 dB or less were obtained in an extremely broad frequency band T4, as shown in FIG. 16. The other operations and effects in the fourth preferred embodiment are similar to those in the aforementioned first preferred embodiment.

Fifth Preferred Embodiment

Figure 17:
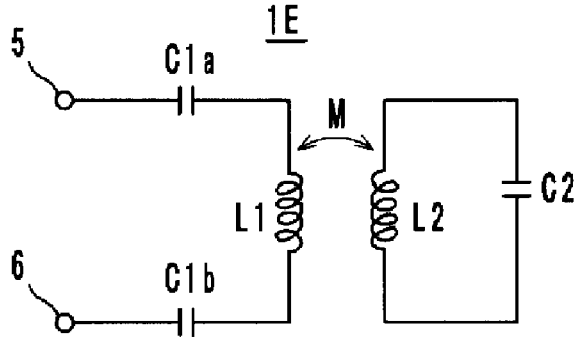
FIG. 17 is an equivalent circuit diagram of an antenna according to a fifth preferred embodiment of the present invention.

An antenna 1E according to a fifth preferred embodiment includes the inductance elements L1 and L2, which have different inductance values and are magnetically coupled together in phase (indicated by the mutual inductance M), as shown as an equivalent circuit in FIG. 17. The inductance element L1 is connected to the power supply terminals 5 and 6 via the capacitance elements C1*a* and C1*b*, and the inductance element L1 and the capacitance elements C1*a* and C1*b* define an LC series resonant circuit. Moreover, the inductance element L2 is connected in series with the capacitance element C2 to define an LC series resonant circuit.

Figure 18:
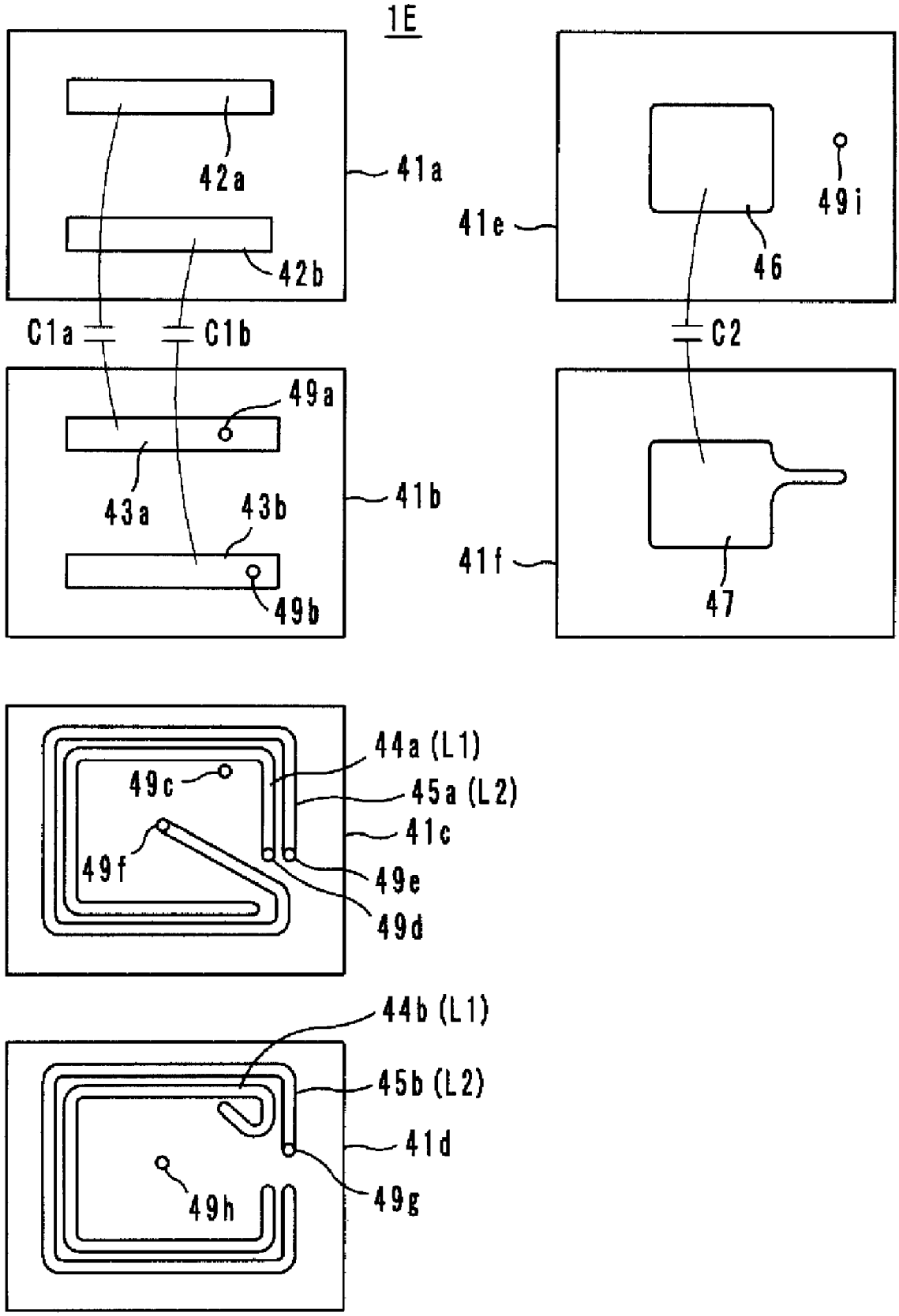
FIG. 18 is a plan view showing a laminated structure of the antenna according to the fifth preferred embodiment of the present invention.

The antenna 1E having the aforementioned circuit configuration is formed as a laminate shown as an example in FIG. 18, and is composed of ceramic sheets 41*a* to 41*f* of dielectric material that are laminated, pressure bonded, and fired together. That is to say, capacitor electrodes 42*a* and 42*b* that also function as the power supply terminals 5 and 6 are provided in the sheet 41*a*, and capacitor electrodes 43*a* and 43*b* and via-hole conductors 49*a* and 49*b* are provided in the sheet 41*b*.

Moreover, conductor patterns 44*a* and 45*a* and via-hole conductors 49*c*, 49*d*, 49*e*, and 49*f* are provided in the sheet 41*c*. Conductor patterns 44*b* and 45*b* and via-hole conductors 49*g* and 49*h* are provided in the sheet 41*d*. A capacitor electrode 46 and a via-hole conductor 49*i* are provided in the sheet 41*e*. Moreover, a capacitor electrode 47 is provided in the sheet 41*f*.

When the aforementioned sheets 41*a* to 41*f* are laminated together, the conductor patterns 44*a* and 44*b* are connected together via the via-hole conductor 49*d*, so that the inductance element L1 is provided, and the conductor patterns 45*a* and 45*b* are connected together via the via-hole conductor 49*e*, so that the inductance element L2 is provided. The capacitance element C1*a* is provided of the electrodes 42*a* and 43*a*, and the capacitance element C1*b* is provided of the electrodes 42*b* and 43*b*. Moreover, the capacitance element C2 is provided of the electrodes 46 and 47.

One end of the inductance element L1 is connected to the capacitor electrode 43*a* via the via-hole conductors 49*c* and 49*a*, and the other end is connected to the capacitor electrode 43*b* via the via-hole conductor 49*b*. One end of the inductance element L2 is connected to the capacitor electrode 46 via the via-hole conductors 49*f* and 49*h*, and the other end is connected to the capacitor electrode 47 via the via-hole conductors 49*g* and 49*i*.

In the antenna 1E having the aforementioned structure, the LC series resonant circuits, which respectively include the inductance elements L1 and L2 magnetically coupled together, resonate, and the inductance elements L1 and L2 function as a radiating element. Moreover, the inductance elements L1 and L2 are magnetically coupled together, so that the LC series resonant circuits function as a matching circuit that matches the impedance (about 50 Ω) of devices connected to the power supply terminals 5 and 6 and the impedance (about 377 Ω) of space.

The operations and effects in the antenna 1E according to the fifth preferred embodiment are similar to those in the antenna 1A according to the aforementioned first preferred embodiment.

Sixth Preferred Embodiment

Figure 19:
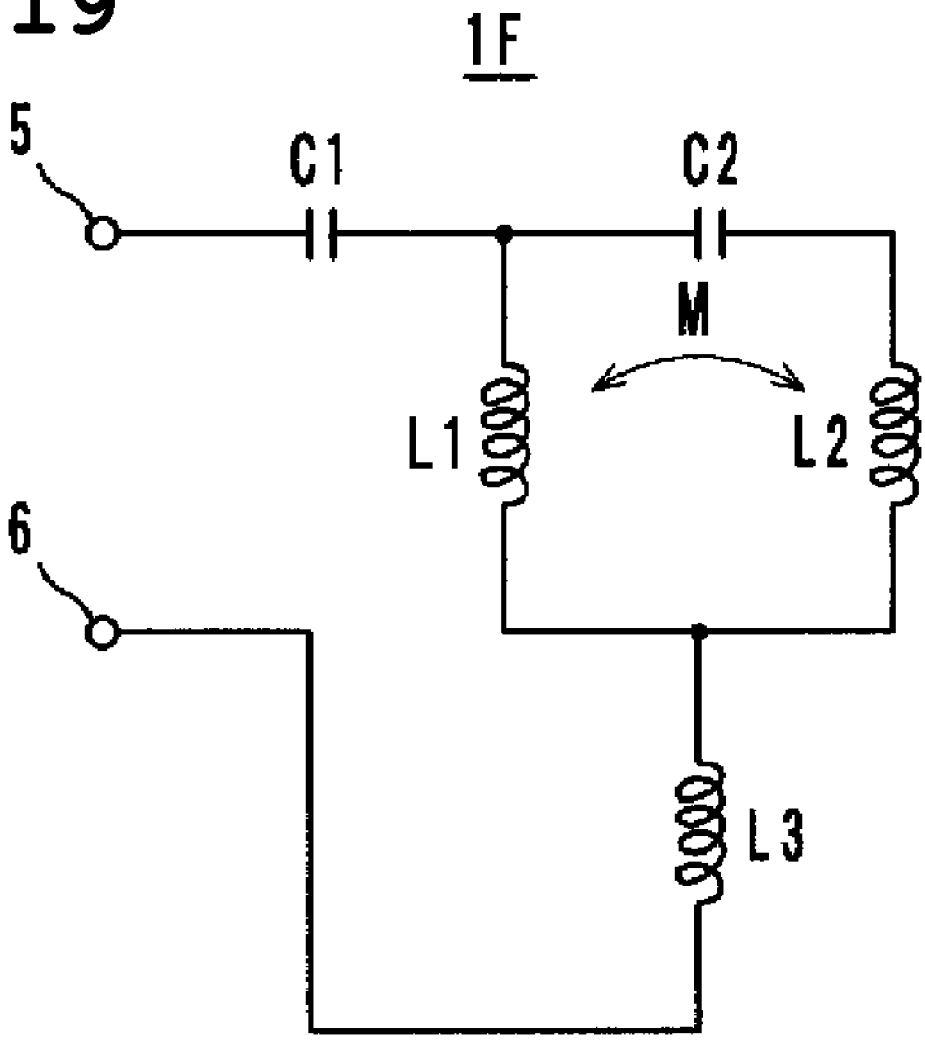
FIG. 19 is an equivalent circuit diagram of an antenna according to a sixth preferred embodiment of the present invention.

An antenna 1F according to a sixth preferred embodiment includes the inductance elements L1 and L2, which have different inductance values and are magnetically coupled together in phase (indicated by the mutual inductance M), as shown as an equivalent circuit in FIG. 19. The inductance element L1 is connected to the power supply terminal 5 via the capacitance element C1, and the inductance element L1 and the capacitance element C1 define an LC series resonant circuit. Moreover, the inductance element L2 is connected in series with the capacitance element C2 to define an LC series resonant circuit. Moreover, one end of the inductance element L3 is connected to the power supply terminal 6, and the other end is connected to the inductance elements L1 and L2. The inductance values of the inductance elements L1, L2, and L3 and the degree (the mutual inductance M) of the magnetic coupling between the inductance elements L1 and L2 are set so that a desired band width is obtained.

Figure 20:
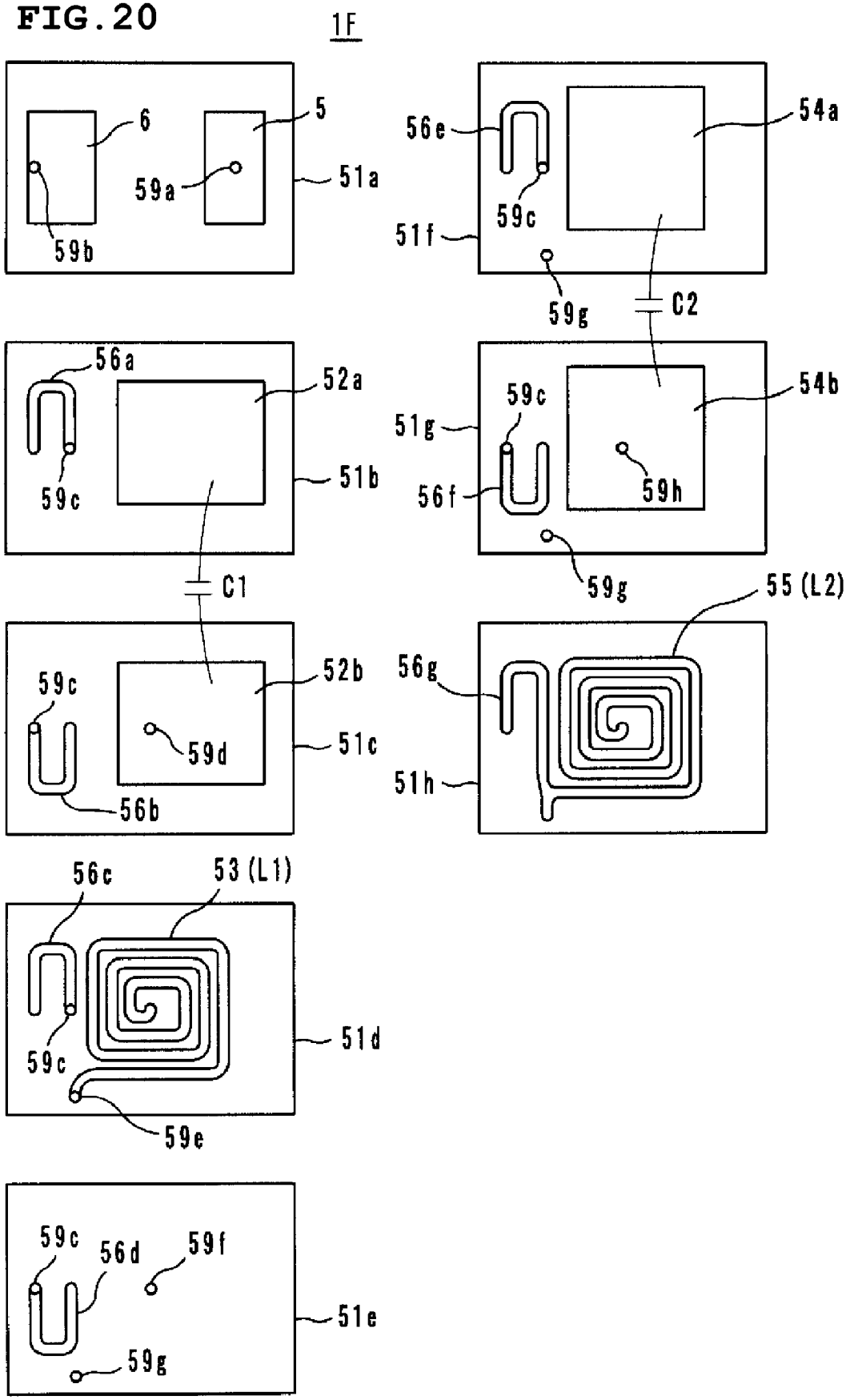
FIG. 20 is a plan view showing a laminated structure of the antenna according to the sixth preferred embodiment of the present invention.

The antenna 1F having the aforementioned circuit configuration is formed as a laminate shown as an example in FIG. 20, and includes ceramic sheets 51*a* to 51*h* of dielectric material that are laminated, pressure bonded, and fired together. That is to say, the power supply terminals 5 and 6 and via-hole conductors 59*a* and 59*b* are provided in the sheet 51*a*. A capacitor electrode 52*a*, a conductor pattern 56*a*, and a via-hole conductor 59*c* are provided at the sheet 51*b*. A capacitor electrode 52*b*, a conductor pattern 56*b*, the via-hole conductor 59*c*, and a via-hole conductor 59*d* are provided at the sheet 51*c*.

Moreover, conductor patterns 53 and 56*c*, the via-hole conductor 59*c*, and a via-hole conductor 59*e* are provided in the sheet 51*d*. A conductor pattern 56*d*, the via-hole conductor 59*c*, and via-hole conductors 59*f* and 59*g* are provided in the sheet 51*e*. A capacitor electrode 54*a*, a conductor pattern 56*e*, and the via-hole conductors 59*c* and 59*g* are provided in the sheet 51*f*. A capacitor electrode 54*b*, a conductor pattern 56*f*, the via-hole conductors 59*c*, 59*g* and 59*h* are provided at the sheet 51*g*. Moreover, a conductor pattern 55 is provided on the sheet 51*h*, and another end of the conductor pattern 55 is provided as a conductor 56*g*.

When the aforementioned sheets 51*a* to 51*h* are laminated together, the conductor pattern 53 is provided as the inductance element L1, and the conductor pattern 55 is provided as the inductance element L2. Moreover, the conductor patterns 56*a* to 56*g* are connected together via the via-hole conductor 59*c* to define the inductance element L3. Moreover, the capacitance element C1 is defined by the capacitor electrodes 52*a* and 52*b*, and the capacitance element C2 is defined the capacitor electrodes 54*a* and 54*b*.

One end of the inductance element L1 is connected to the capacitor electrode 52*b* via the via-hole conductor 59*d*, and the other end is connected to another end of the inductance element L2 via the via-hole conductors 59*e* and 59*g*. One end of the inductance element L2 is connected to the capacitor electrode 54*b* via the via-hole conductor 59*h*, and the other end is connected to the other end of the inductance element L1 via the via-hole conductors 59*g* and 59*e*, as described above, and is connected to one end (the conductor pattern 56*g*) of the inductance element L3. The other end of the inductance element L3 is connected to the power supply terminal 6 via the via-hole conductor 59*b*. Moreover, the capacitor electrode 52*a* is connected to the power supply terminal 5 via the via-hole conductor 59*a*.

In the antenna 1F having the aforementioned structure, the LC series resonant circuits, which respectively include the inductance elements L1 and L2 magnetically coupled together, resonate, and the inductance elements L1 and L2 function as a radiating element. Moreover, the inductance elements L1 and L2 are magnetically coupled together, so that the LC series resonant circuits function as a matching circuit that matches the impedance (about 50 Ω) of devices connected to the power supply terminals 5 and 6 and the impedance (about 377 Ω) of space.

In the antenna 1F, even when the magnetic coupling between the inductance elements L1 and L2 is weak, since the elements L1 and L2 are directly connected to each other, a broad band is ensured. Moreover, since the other ends of the inductance elements L1 and L2 are connected to the power supply terminal 6 via the inductance element L3, the coupling coefficient k between the inductance elements L1 and L2 can be increased. Moreover, the inductance element L3 is added, so that a broad band is achieved even when the coupling coefficient between the inductance elements L1 and L2 is relatively small. The other operations and effects in the antenna 1F according to the sixth preferred embodiment are similar to those in the antenna 1A according to the aforementioned first preferred embodiment.

Other than the aforementioned first to sixth preferred embodiments, various types of resonant circuits that define an antenna, for example, shown as equivalent circuits in FIG. 21A to 21E, can be used, and broad-band characteristics can be achieved with small circuits.

Figure 21A:
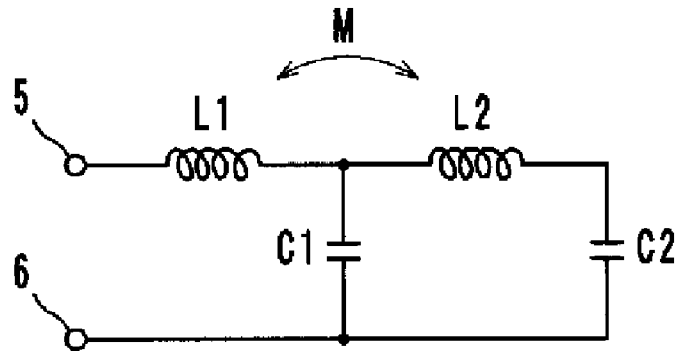
FIGS. 21A to 21E show equivalent circuit diagrams of antennas according to other preferred embodiments of the present invention.

In FIG. 21A, the inductance element L1 and the capacitance element C1 define an LC series resonant circuit, and the inductance element L2 and the capacitance element C2 define an LC series resonant circuit. The inductance elements L1 and L2 are directly connected to each other, one end of the inductance element L1 is connected to the power supply terminal 5, and the capacitance elements C1 and C2 are connected to the power supply terminal 6.

Figure 21B:
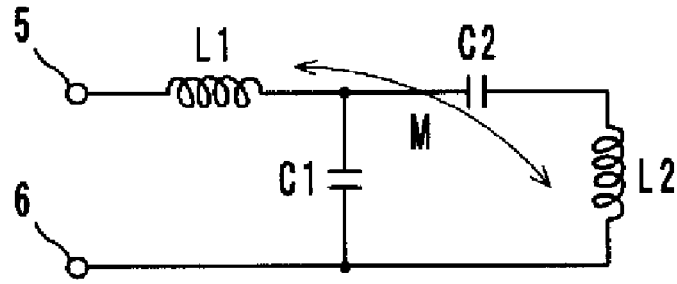

In FIG. 21B, the inductance element L1 and the capacitance element C1 define an LC series resonant circuit, and the inductance element L2 and the capacitance element C2 define an LC series resonant circuit. One end of the inductance element L1 is connected to the power supply terminal 5, the capacitance element C2 is connected between the inductance elements L1 and L2, and the capacitance element C1 and another end of the inductance element L2 are connected to the power supply terminal 6.

Figure 21C:
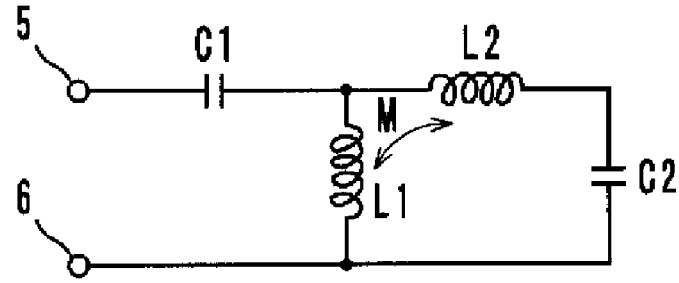

In FIG. 21C, the inductance element L1 and the capacitance element C1 define an LC series resonant circuit, and the inductance element L2 and the capacitance element C2 define an LC series resonant circuit. The inductance elements L1 and L2 are directly connected to each other, the capacitance element C1 is connected to the power supply terminal 5, and the capacitance element C2 and another end of the inductance element L1 are connected to the power supply terminal 6.

Figure 21D:
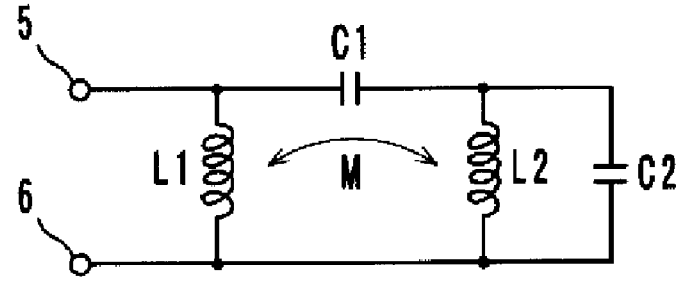

In FIG. 21D, the inductance element L1 and the capacitance element C1 define an LC series resonant circuit, and the inductance element L2 and the capacitance element C2 define an LC series resonant circuit. One end of the inductance element L1 is connected to one end of the inductance element L2 via the capacitance element C1, and the other ends of the inductance elements L1 and L2 are directly connected to each other. The one end of the inductance element L1 is connected to the power supply terminal 5, and the other ends of the inductance elements L1 and L2 are connected to the power supply terminal 6.

Figure 21E:
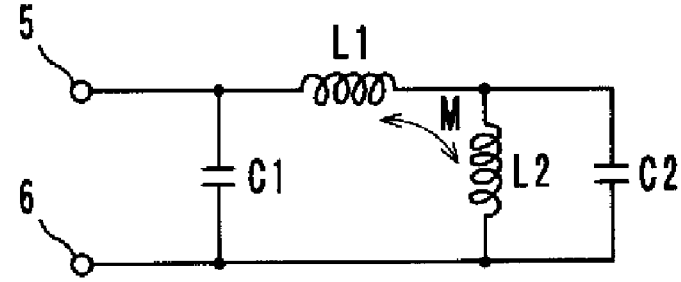

In FIG. 21E, the inductance element L1 and the capacitance element C1 define an LC series resonant circuit, and the inductance element L2 and the capacitance element C2 define an LC series resonant circuit. The inductance elements L1 and L2 are directly connected to each other, a node between one end of the inductance element L1 and the capacitance element C1 is connected to the power supply terminal 5, and a node between another end of the inductance element L2 and the capacitance element C1 is connected to the power supply terminal 6.

Seventh Preferred Embodiment

Figure 22:
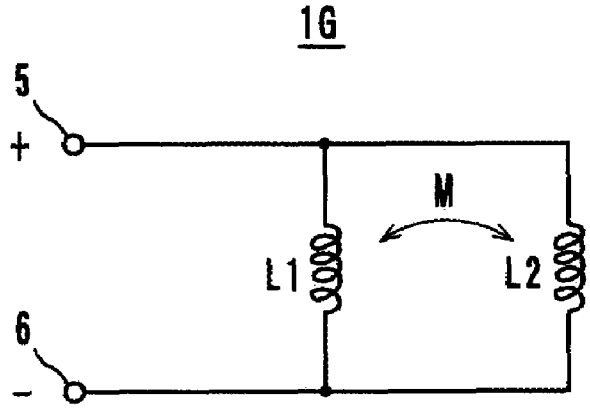
FIG. 22 is an equivalent circuit diagram of an antenna according to a seventh preferred embodiment of the present invention.

An antenna 1G according to a seventh preferred embodiment includes the inductance elements L1 and L2, which have different inductance values and are magnetically coupled together in phase (indicated by the mutual inductance M), as shown as an equivalent circuit in FIG. 22. The inductance elements L1 and L2 are connected in parallel with the power supply terminals 5 and 6.

In the antenna 1G having the aforementioned circuit configuration, the inductance elements L1 and L2 have different inductance values and are magnetically coupled together in phase. Then, the mutual inductance M (=L1−L2) is produced by the magnetic coupling between the inductance elements L1 and L2. According to a simulation performed by the inventor, the antenna 1G was found to function as a radiating element having reflection characteristics in a broad band, as shown in FIG. 23.

Figure 23:
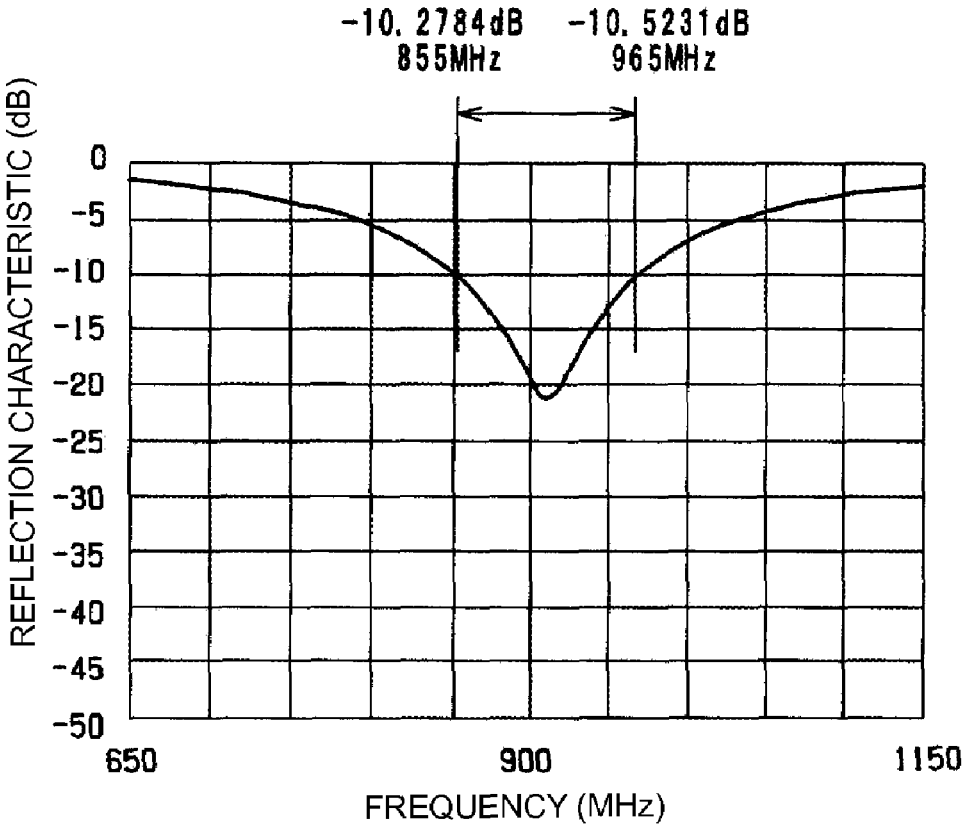
FIG. 23 is a graph showing reflection characteristics of the antenna according to the seventh preferred embodiment of the present invention.

When a matching circuit is defined by only the two inductance elements L1 and L2, although the impedance or reactance of devices connected to the power supply terminals 5 and 6 is restricted, reflection characteristics in a broad band are obtained, as shown in FIG. 23.

Eighth Preferred Embodiment

Figure 24:
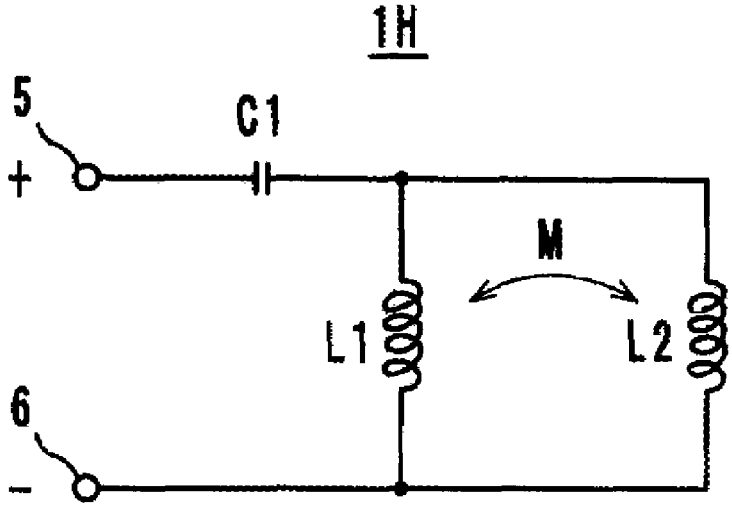
FIG. 24 is an equivalent circuit diagram of an antenna according to an eighth preferred embodiment of the present invention.

An antenna 1H according to an eighth preferred embodiment includes the inductance elements L1 and L2 shown in the aforementioned seventh preferred embodiment and the capacitance element C1 connected between one end of the inductance element L1 and the power supply terminal 5, as shown as an equivalent circuit in FIG. 24.

Figure 25:
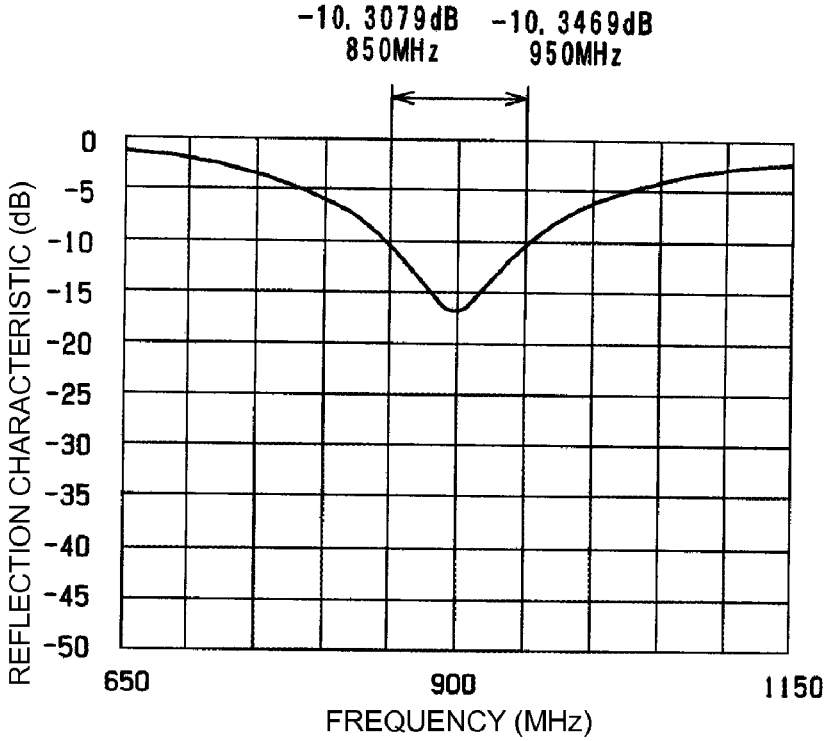
FIG. 25 is a graph showing reflection characteristics of the antenna according to the eighth preferred embodiment of the present invention.

In the antenna 1H having the aforementioned circuit configuration, the mutual inductance M is produced by the magnetic coupling between the inductance elements L1 and L2, which have different inductance values. According to a simulation performed by the inventor, reflection characteristics in a broad band shown in FIG. 25 are obtained.

Ninth Preferred Embodiment

Figure 26:
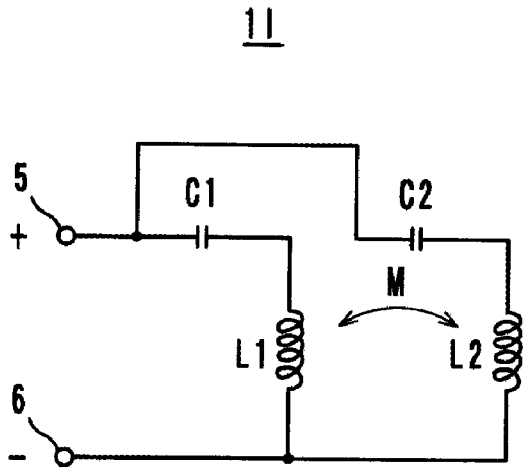
FIG. 26 is an equivalent circuit diagram of an antenna according to a ninth preferred embodiment of the present invention.

An antenna 1I according to a ninth preferred embodiment includes the inductance elements L1 and L2 shown in the aforementioned seventh preferred embodiment and the capacitance elements Cl and C2 respectively connected between the power supply terminal 5 and ends of the inductance elements L1 and L2, as shown as an equivalent circuit in FIG. 26.

Figure 27:
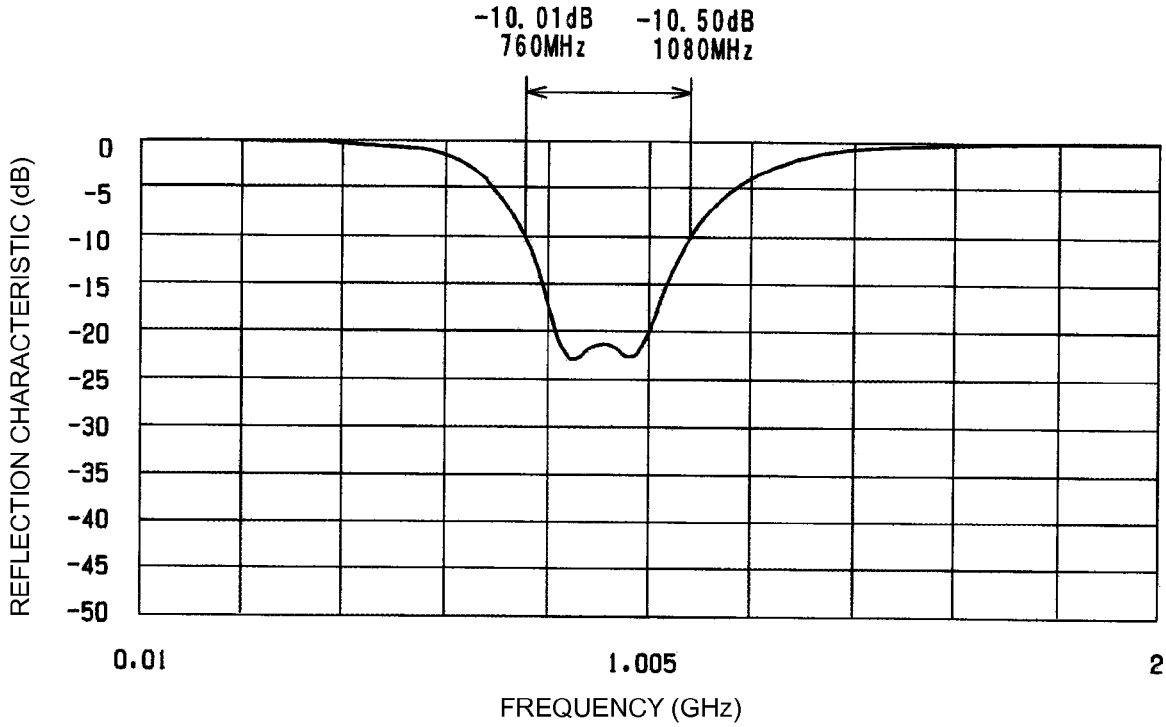
FIG. 27 is a graph showing reflection characteristics of the antenna according to the ninth preferred embodiment of the present invention.

In the antenna 1I having the aforementioned circuit configuration, the mutual inductance M is produced by the magnetic coupling between the inductance elements L1 and L2, which have different inductance values. According to a simulation performed by the inventor, reflection characteristics in a broad band shown in FIG. 27 are obtained.

Tenth Preferred Embodiment

Figure 28:
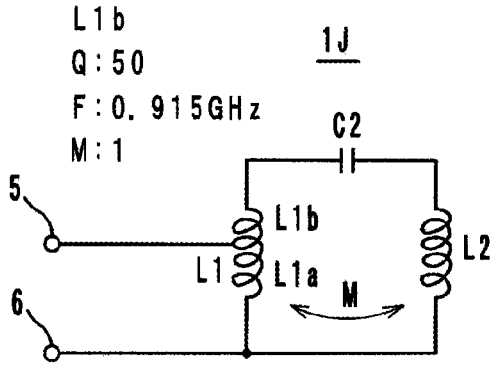
FIG. 28 is an equivalent circuit diagram of an antenna according to a tenth preferred embodiment of the present invention.

In an antenna 1J according to a tenth preferred embodiment shown as an equivalent circuit in FIG. 28, what is called a mid tap is provided in the inductance element L1 shown in the aforementioned second preferred embodiment, the power supply terminal 5 is connected to the mid tap, and the capacitance element C1 is omitted.

Although the operations and effects are substantially the same as those in the second preferred embodiment, the impedance of space and the impedance of devices connected between the power supply terminals 5 and 6 can be matched without a decrease in the electromagnetic field energy by providing a mid tap so as to suit the impedance between the power supply terminals 5 and 6. In this case, the inductance element L1 is divided into inductances L1*a* and L1*b*.

Figure 29:
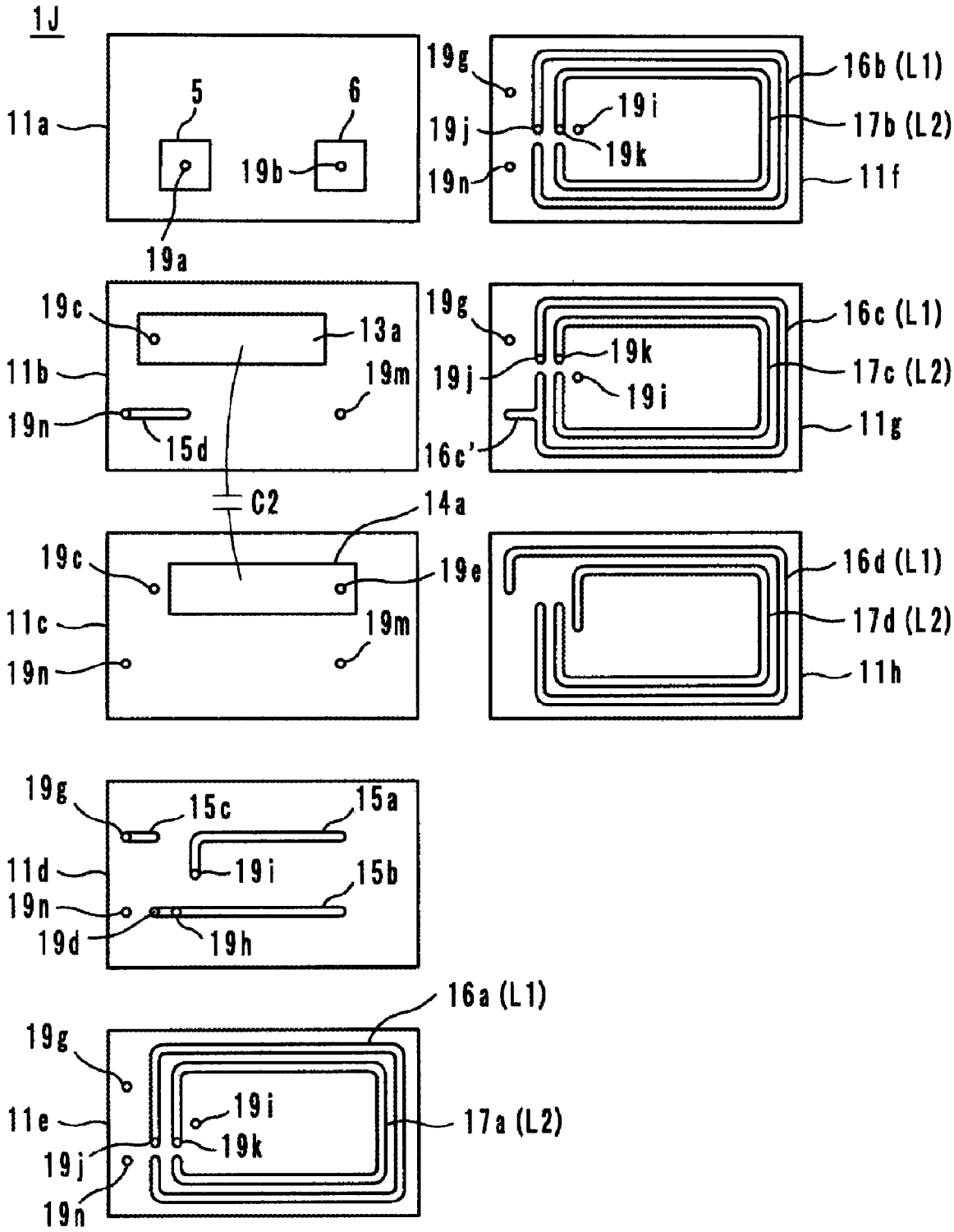
FIG. 29 is a plan view showing a laminated structure of the antenna according to the tenth preferred embodiment of the present invention.

The antenna 1J having the aforementioned circuit configuration is formed as a laminate shown as an example in FIG. 29, and includes the ceramic sheets 11*a* to 11*h* of dielectric material that are laminated, pressure bonded, and fired together. That is to say, the power supply terminals 5 and 6 and the via-hole conductors 19*a* and 19*b* are provided in the sheet 11*a*, the capacitor electrode 13*a*, a connecting conductor pattern 15*d*, the via-hole conductors 19*c*, 19*m* and 19*n* are provided at the sheet 11*b*, and the capacitor electrode 14*a* and the via-hole conductors 19*c*, 19*e*, 19*m*, and 19*n* are provided at the sheet 11*c*.

Moreover, the connecting conductor patterns 15*a*, 15*b*, and 15*c* and the via-hole conductors 19*d*, 19*g*, 19*h*, 19*i*, and 19*n* are provided at the sheet 11*d*. The conductor patterns 16*a* and 17*a* and the via-hole conductors 19*g*, 19*i*, 19*j*, 19*k*, and 19*n* are provided at the sheet 11*e*. The conductor patterns 16*b* and 17*b* and the via-hole conductors 19*g*, 19*i*, 19*j*, 19*k*, and 19*n* are provided at the sheet 11*f*. The conductor patterns 16*c* and 17*c* and the via-hole conductors 19*g*, 19*i*, 19*j*, and 19*k* are provided at the sheet 11*g*. Moreover, the conductor patterns 16*d* and 17*d* are provided at the sheet 11*h*.

When the aforementioned sheets 11*a* to 11*h* are laminated together, the conductor patterns 16*a* to 16*d* are connected together via the via-hole conductor 19*j*, so that the inductance element L1 is provided. A branch 16*c*' of the conductor pattern 16*c* functions as a mid tap, and the branch 16*c*' is connected to the power supply terminal 5 via the via-hole conductor 19*n*, the connecting conductor pattern 15*d*, and the via-hole conductor 19*a*. Moreover, the conductor patterns 17*a* to 17*d* are connected together via the via-hole conductor 19*k*, so that the inductance element L2 is provided. The capacitance element C2 is defined by the electrodes 13*a* and 14*a*.

One end of the inductance element L1 is connected to the capacitor electrode 13*a* via the via-hole conductor 19*g*, the connecting conductor pattern 15*c*, and the via-hole conductor 19*c*, and the other end is connected to the power supply terminal 6 via the via-hole conductor 19*d*, the connecting conductor pattern 15*b*, and the via-hole conductors 19*m* and 19*b*.

On the other hand, one end of the inductance element L2 is connected to the capacitor electrode 14*a* via the via-hole conductor 19*i*, the connecting conductor pattern 15*a*, and the via-hole conductor 19*e*, and the other end is connected to the power supply terminal 6 via the via-hole conductor 19*h*, the connecting conductor pattern 15*b*, and the via-hole conductors 19*m* and 19*b*. The other ends of the inductance elements L1 and L2 are connected via the connecting conductor pattern 15*b*.

In the antenna 1J having the aforementioned structure, the LC series resonant circuits, which respectively include the inductance elements L1 and L2 magnetically coupled together, resonate, and the inductance elements L1 and L2 function as a radiating element. Moreover, the inductance elements L1 and L2 are coupled together via the capacitance element C2, and the branch 16*c*' (the mid tap) is provided, so that the LC series resonant circuits function as a matching circuit that matches the impedance (about 50 Ω) of devices connected to the power supply terminals 5 and 6 and the impedance (about 377 Ω) of space.

Figure 30:
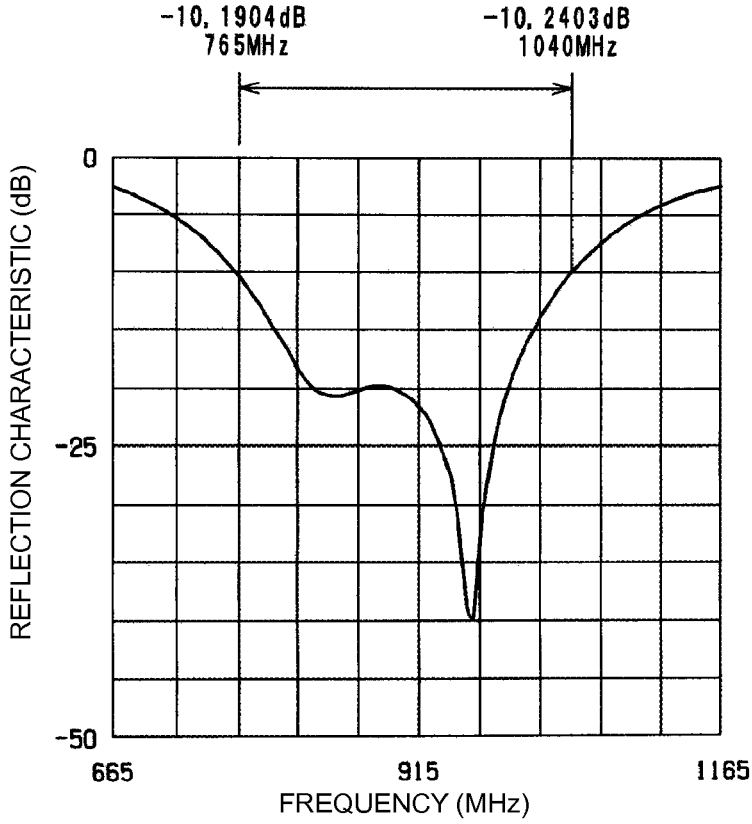
FIG. 30 is a graph showing reflection characteristics of the antenna according to the tenth preferred embodiment of the present invention.

As the result of a simulation performed by the inventor using the equivalent circuit shown in FIG. 28, in the antenna 1J, reflection characteristics shown in FIG. 30 were obtained.

Eleventh Preferred Embodiment

Figure 31:
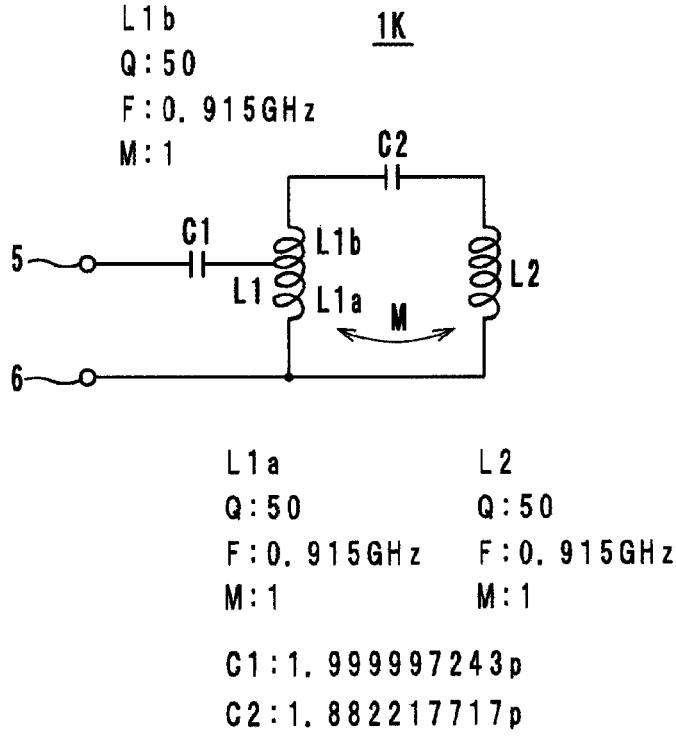
FIG. 31 is an equivalent circuit diagram of an antenna according to an eleventh preferred embodiment of the present invention.

An antenna 1K according to an eleventh preferred embodiment is substantially the same as the antenna 1J shown in the aforementioned tenth preferred embodiment, the capacitance element C1 being added to the antenna 1J, as shown as an equivalent circuit in FIG. 31. The operations and effects are similar to those in the tenth preferred embodiment. The impedance of space and the impedance of devices connected between the power supply terminals 5 and 6 can be matched without decrease in the electromagnetic field energy by providing a mid tap so as to suit the impedance between the power supply terminals 5 and 6. Impedance matching with the power supply terminals 5 and 6 is facilitated by adding the capacitance element C1 to the tenth preferred embodiment.

Figure 32:
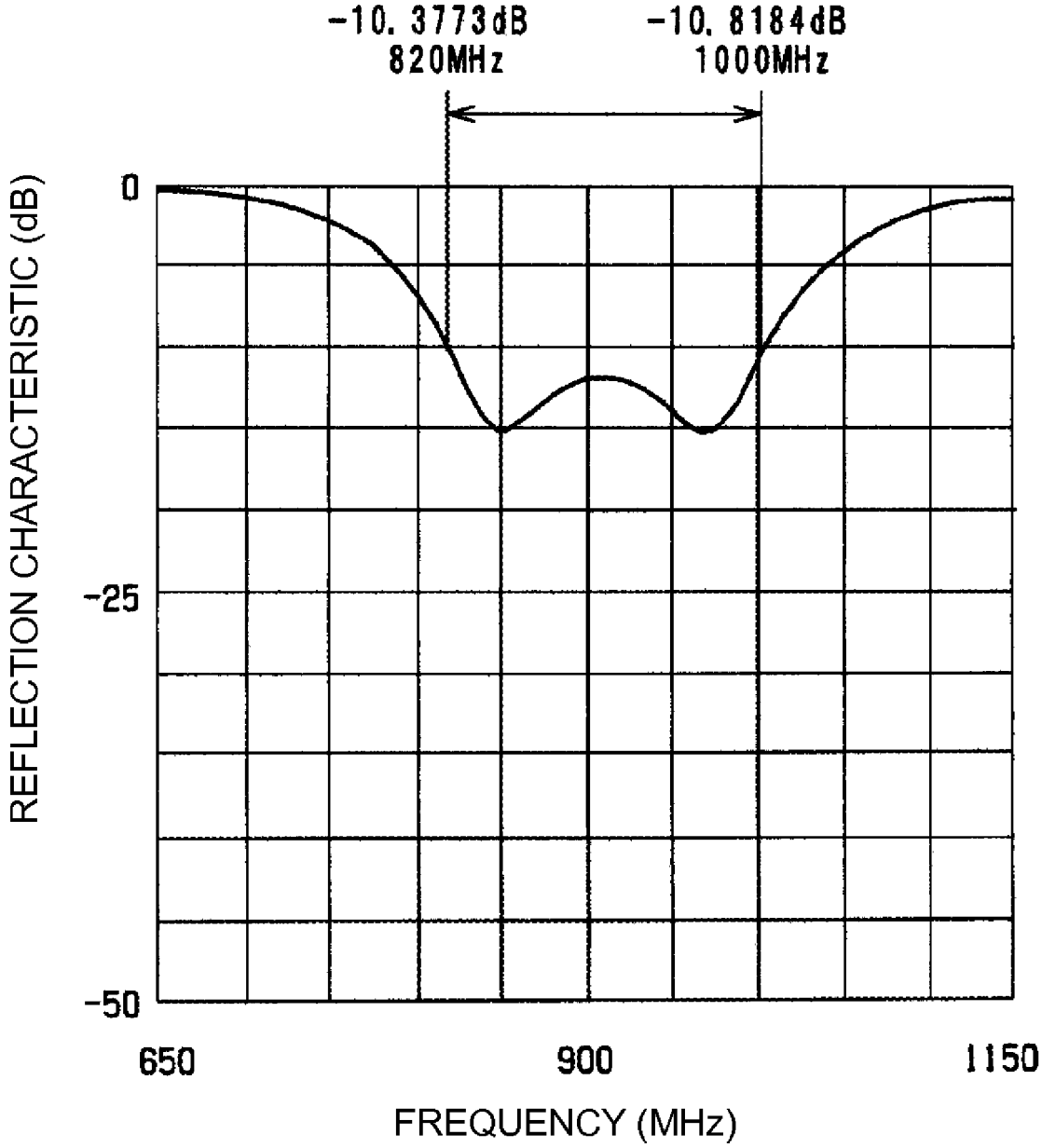
FIG. 32 is a graph showing reflection characteristics of the antenna according to the eleventh preferred embodiment of the present invention.

The structure of the antenna 1K having the aforementioned circuit configuration is similar to those of the laminates shown in FIGS. 8 and 29, and thus, the details are omitted. As the result of a simulation performed by the inventor using the equivalent circuit shown in FIG. 31, in the antenna 1K, reflection characteristics shown in FIG. 32 were obtained.

When impedance matching with the power supply terminals 5 and 6 is facilitated by providing a mid tap, as in the tenth and eleventh preferred embodiments, the return increases, and the band width increases accordingly. That is to say, when the degree of impedance matching changes, the band width changes. Thus, in order to obtain a desired band, the degree of impedance matching must be considered when constants of individual inductance elements are set.

Antennas according to the present invention are not limited to the aforementioned preferred embodiments, and the preferred embodiments can be modified within the scope of the present invention.

In the aforementioned preferred embodiments, an LC resonant circuit includes a lumped constant resonant circuit. Alternatively, the LC resonant circuit may include, for example, a distributed constant resonant circuit. Moreover, a laminate that includes the LC resonant circuit may be composed of insulating material, instead of dielectric material, and ceramic, resin, or other suitable materials can be used.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The invention claimed is:

1. An antenna comprising:

first and second power supply terminals; and a plurality of resonant circuits;

a first LC series resonant circuit including a first inductance element and first and second capacitance elements that are electrically connected to both ends of the first inductance element; and a second LC series resonant circuit including a second inductance element and third and fourth capacitance elements that are electrically connected to both ends of the second inductance element; wherein the first and second inductance elements are magnetically coupled together;

one end of the first inductance element is electrically connected to the first power supply terminal via the first capacitance element, and the other end is electrically connected to the second power supply terminal via the second capacitance element; and one end of the second inductance element is electrically connected to the first power supply terminal via the third and first capacitance elements, and the other end is electrically connected to the second power supply terminal via the fourth and second capacitance elements.

* * * * *